US011944863B2

(12) United States Patent
Olson et al.

(10) Patent No.: US 11,944,863 B2
(45) **Date of Patent: *Apr. 2, 2024**

(54) DUMBBELL SYSTEM

(71) Applicant: PowerBlock Holdings, Inc., Owatonna, MN (US)

(72) Inventors: Gregory Scott Olson, Owatonna, MN (US); Carl K. Towley, III, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 242 days.

This patent is subject to a terminal disclaimer.

(21) Appl. No.: 17/512,752

(22) Filed: Oct. 28, 2021

(65) Prior Publication Data

US 2022/0249899 A1 Aug. 11, 2022

Related U.S. Application Data

(63) Continuation-in-part of application No. 17/173,331, filed on Feb. 11, 2021, now Pat. No. 11,229,819.

(51) Int. Cl.

| | |
|---|---|
| ***A63B 21/075*** | (2006.01) |
| ***A63B 21/00*** | (2006.01) |
| ***A63B 21/072*** | (2006.01) |

(52) U.S. Cl.

CPC ..... *A63B 21/075* (2013.01); *A63B 21/0726* (2013.01); *A63B 21/0728* (2013.01); *A63B 21/4035* (2015.10)

(58) Field of Classification Search

CPC ..... A63B 21/072–075; A63B 21/0726; A63B 21/0728; A63B 21/4035

See application file for complete search history.

(56) References Cited

U.S. PATENT DOCUMENTS

| | | | | |
|---|---|---|---|---|
| 4,787,628 A | | 11/1988 | Harwick | |
| 5,046,725 A | * | 9/1991 | Brennan | A63B 21/0632 482/50 |
| D359,778 S | | 6/1995 | Towley, III | |
| 5,637,064 A | * | 6/1997 | Olson | A63B 21/0728 482/107 |
| 6,083,144 A | | 7/2000 | Towley, III | |

(Continued)

FOREIGN PATENT DOCUMENTS

| | | |
|---|---|---|
| WO | WO2005075027 | 8/2005 |
| WO | WO2020157572 | 8/2020 |

*Primary Examiner* — Joshua Lee
*Assistant Examiner* — Catrina A Letterman
(74) *Attorney, Agent, or Firm* — Merchant & Gould P.C.

(57) ABSTRACT

A dumbbell system a plurality of weights vertically stackable on top of each other and each of the weights has a pair of outer edges disposed oppositely from each other to define a first lateral edge and a second lateral edge. The weights each have a centrally displaced opening vertically extending therethrough and defining a receiving space. The receiving space of each weight is vertically aligned with the receiving space of each of the other weights. A handle is removably extendable into the receiving space. A coupler releasably engages a selected one of the weights to the handle and defines a coupled weight. The coupled weight and each of the weights positioned above the coupled weight is releasably secured to the handle. Each of the weights positioned below the coupled weight are disengaged from the handle.

14 Claims, 28 Drawing Sheets

(56) References Cited

U.S. PATENT DOCUMENTS 6,461,282 B1 10/2002 Fenelon
6,896,645 B1 * 5/2005 Krull ..... A63B 21/0605 482/106
7,014,598 B2 3/2006 Fenelon
7,025,713 B2 4/2006 Dalebout
7,153,244 B2 12/2006 Towley, III
7,335,145 B2 2/2008 Towley, III
7,387,596 B2 6/2008 Towley, III
7,491,155 B2 2/2009 Fenelon
7,520,845 B2 4/2009 Towley, III
7,549,952 B2 6/2009 Towley, III
7,563,208 B1 7/2009 Chen
7,578,771 B1 8/2009 Towley, III
7,722,511 B2 5/2010 Towley, III
7,731,640 B1 6/2010 Chen
7,762,933 B1 * 7/2010 Yu ..... A63B 21/075 482/109
7,771,330 B2 8/2010 Towley, III
7,775,947 B2 8/2010 Towley, III
7,850,581 B2 12/2010 Towley, III
7,854,693 B2 12/2010 Towley, III
7,857,735 B2 12/2010 Towley, III
7,878,952 B2 2/2011 Fenelon
7,918,772 B2 4/2011 Towley, III
D644,701 S 9/2011 Towley, III
8,012,069 B2 9/2011 Towley, III
D651,672 S 1/2012 Towley, III
D652,877 S 1/2012 Dalebout
8,157,711 B2 4/2012 Towley, III
D664,613 S 7/2012 Dalebout
8,267,841 B1 9/2012 Allison
8,394,004 B2 3/2013 Towley, III
8,668,630 B2 3/2014 Towley, III
8,771,153 B2 7/2014 Dalebout
9,011,300 B2 4/2015 Hodes
9,022,906 B1 5/2015 Nelson
9,132,312 B2 9/2015 Henley
9,446,283 B2 9/2016 Nelson
9,616,270 B2 4/2017 Towely
9,795,823 B2 10/2017 Wyncott
10,035,037 B2 7/2018 Towley
10,086,225 B2 10/2018 Sheppard
10,099,083 B1 10/2018 Owusu
10,166,429 B2 1/2019 Chen
10,463,906 B2 11/2019 Owusu
10,702,732 B2 * 7/2020 Towley, III ..... A63B 21/065
10,786,700 B2 9/2020 Owusu
10,953,264 B2 * 3/2021 Towley, III ..... A63B 21/0726
11,213,715 B1 * 1/2022 Olson ..... A63B 21/0726
11,229,819 B1 * 1/2022 Olson ..... A63B 21/0726
2004/0162198 A1 * 8/2004 Towley, III ..... A63B 21/0726 482/107
2007/0087918 A1 * 4/2007 Towley ..... A63B 21/075 482/107
2007/0135274 A1 6/2007 Blateri
2008/0081744 A1 4/2008 Gormley
2011/0312475 A1 * 12/2011 Towley, III ..... A63B 21/0726 482/107
2012/0264575 A1 * 10/2012 Towley, III ..... A63B 21/00065 482/107
2015/0105224 A1 4/2015 Odneal
2016/0236029 A1 8/2016 Kaszer
2017/0056703 A1 3/2017 Phelps
2017/0209731 A1 * 7/2017 Towley, III ..... A63B 23/12
2019/0344113 A1 11/2019 Tran
2019/0344114 A1 11/2019 Tran

* cited by examiner 10
15
20
25
30
35
40
45
50
10
15
20
25
30
35
40
45
50
10
15
20
25
10
15
20
25
10
15
20
25

DUMBBELL SYSTEM

CROSS-REFERENCE TO RELATED APPLICATIONS

This is a continuation in part application and I hereby claim the benefit under 35 U.S.C., Section 120 of U.S. application Ser. No. 17/173,331 filed Feb. 11, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to modular weight device and more particularly pertains to a new modular weight device for allowing a person to alter the mass of an exercising weight and more particularly for a dumbbell. The device herein allows a person to add or remove weights to the dumbbell such that the overall mass of the dumbbell is selectively alterable.

(2) Description of Related Art Including Information Disclosed Under 37 CFR 1.97 and 1.98

The prior art relates to modular weight devices whereby a person is provided with a set of weight elements that are removable from, or attachable to, a grip such that overall mass of the weight device is adjustable as needed.

BRIEF SUMMARY OF THE INVENTION

An embodiment of the disclosure meets the needs presented above by generally comprising a plurality of weights that are vertically stackable on top of each other. Each of the weights has a pair of outer edges disposed oppositely from each other and define a first lateral edge and a second lateral edge. The weights each have a centrally displaced opening vertically extending therethrough and defining a receiving space. The receiving space of each weight is vertically aligned with the receiving space of each of the other weights. A handle is removably extendable into the receiving space. A coupler releasably engages a selected one of the weights to the handle and defines a coupled weight. The coupled weight and each of the weights positioned above the coupled weight is releasably secured to the handle. Each of the weights positioned below the coupled weight are disengaged from the handle.

Another embodiment of the disclosure includes a plurality of weights vertically stackable on top of each other. Each of the weights has a pair of outer edges disposed oppositely from each other and defining a first lateral edge and a second lateral edge. The weights each have a centrally positioned opening vertically extending therethrough and defining a receiving space. The receiving space of each weight is vertically aligned with the receiving space of each of the other weights. Each of the weights has a center of mass, wherein the center of mass of each weight is positioned above the center of mass of a next adjacent weight positioned there-below such that center of masses of all of the weights are vertically spaced from each other. A handle is removably extendable into the receiving space. A coupler releasably engages a selected one of the weights to the handle and defines a coupled weight. The coupled weight and each of the weights positioned above the coupled weight is releasably secured to the handle and each of the weights positioned below the coupled weight are disengaged from the handle.

In another embodiment, a plurality of weights is provided that are vertically stackable on top of each other. Each of the weights has a pair of outer edges disposed oppositely from each other and defining a first lateral edge and a second lateral edge. The weights each have a centrally displaced opening vertically extending therethrough and defining a receiving space. The receiving space of each weight is vertically aligned with the receiving spaces of each of the other weights. A handle is removably extendable into the receiving space. The handle has a grip that is positioned below an uppermost one of the plurality of weights and above a lowermost one of the plurality of weights when the handle is positioned in the receiving space. A coupler releasably engages a selected one of the weights to the handle and defines a coupled weight wherein the coupled weight and each of the weights positioned above the coupled weight are each releasably secured to the handle while each of the weights positioned below the coupled weight are disengaged from the handle. Each of the weights includes a unitary structure comprising a single plate having the centrally displaced opening extending therethrough. The single plate of each weight has an inner perimeter edge defining the centrally displaced opening. The inner perimeter edge of each weight bounds the handle when the handle is in the receiving space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
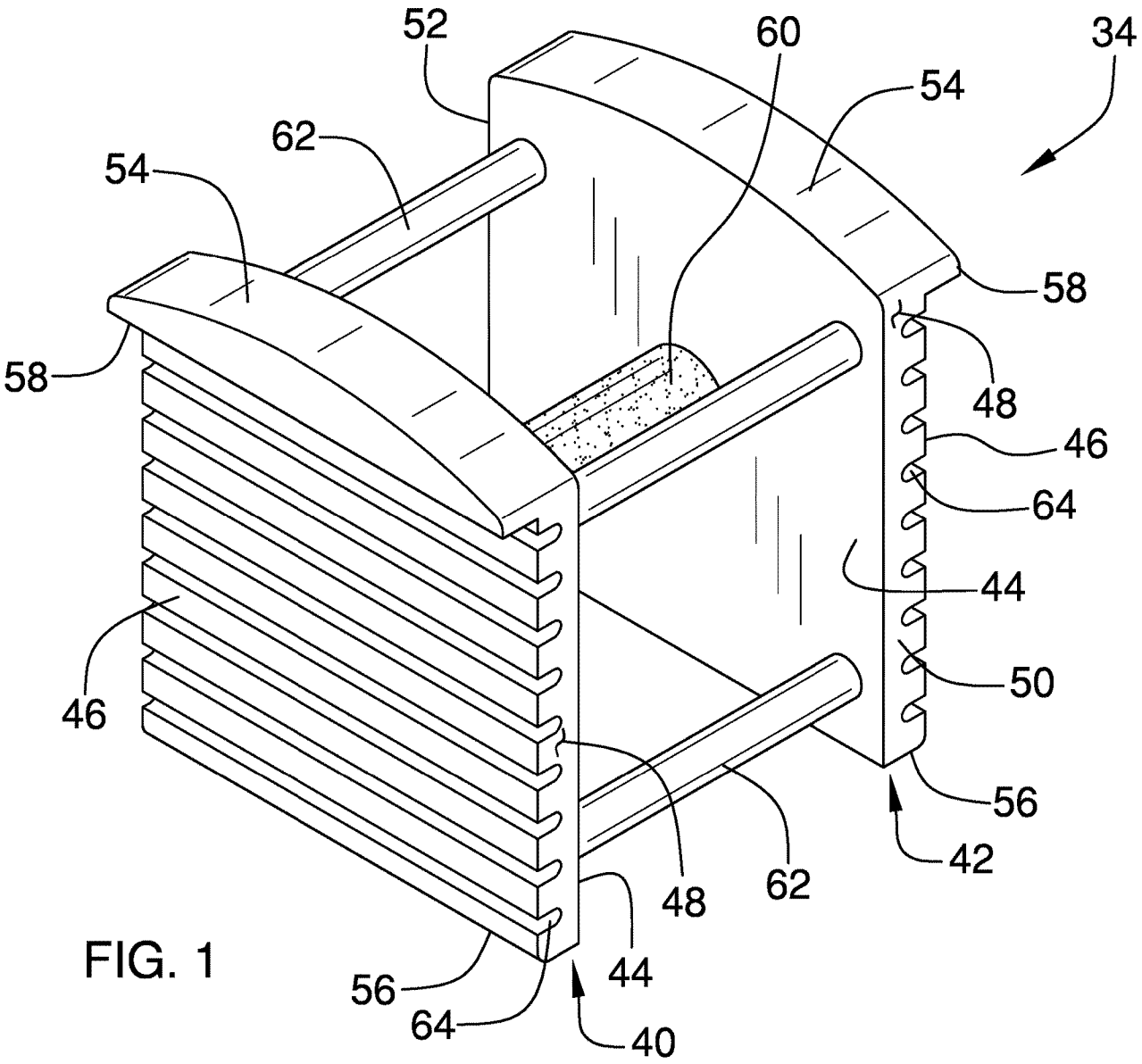
FIG. 1 is a front isometric view of a handle of a dumbbell system according to an embodiment of the disclosure.

With reference now to the drawings, and in particular to FIGS. 1 through 28 thereof, a new modular weight device embodying the principles and concepts of an embodiment of the disclosure and generally designated by the reference numeral 10 will be described.

As best illustrated in FIGS. 1 through 28, the dumbbell system 10 generally comprises a plurality of weights 12 that are vertically stackable on top of each other. There term "stackable" herein has the definition of each weight being supported by the weight positioned directly there-below. Thus, when the system 10 of the plurality of weights 12 is placed on a surface, a bottommost one of the weights 12 will be the only weight 12 abutting the surface while each successive stacked weight will be farther from the surface than the weight 12 upon which it rests. As another example, the center of mass of each weight 12 will be positioned higher than the weight 12 upon which it is stacked.

Figure 7:
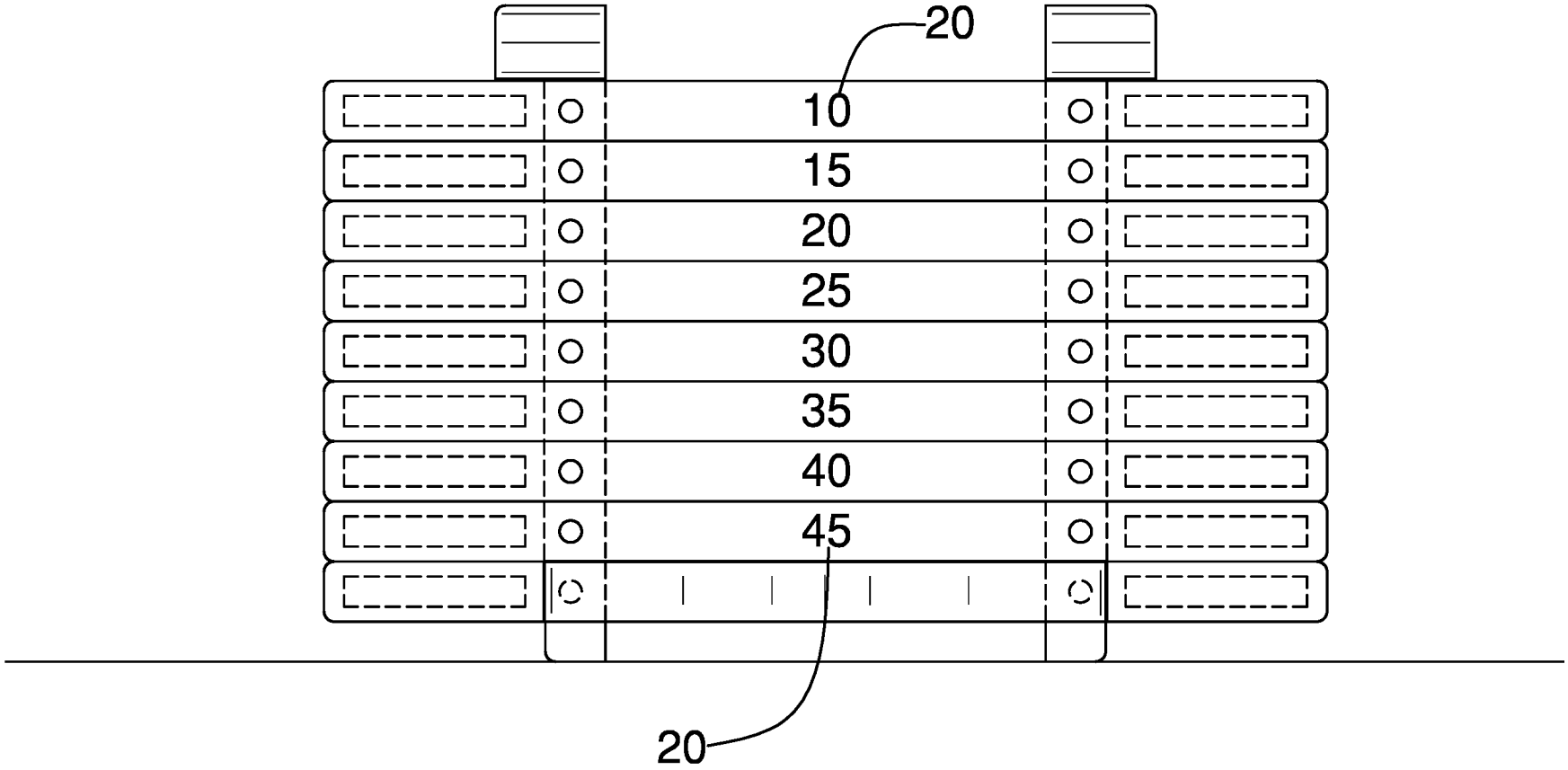
FIG. 7 is a front view of an embodiment of the disclosure.
Figure 8:
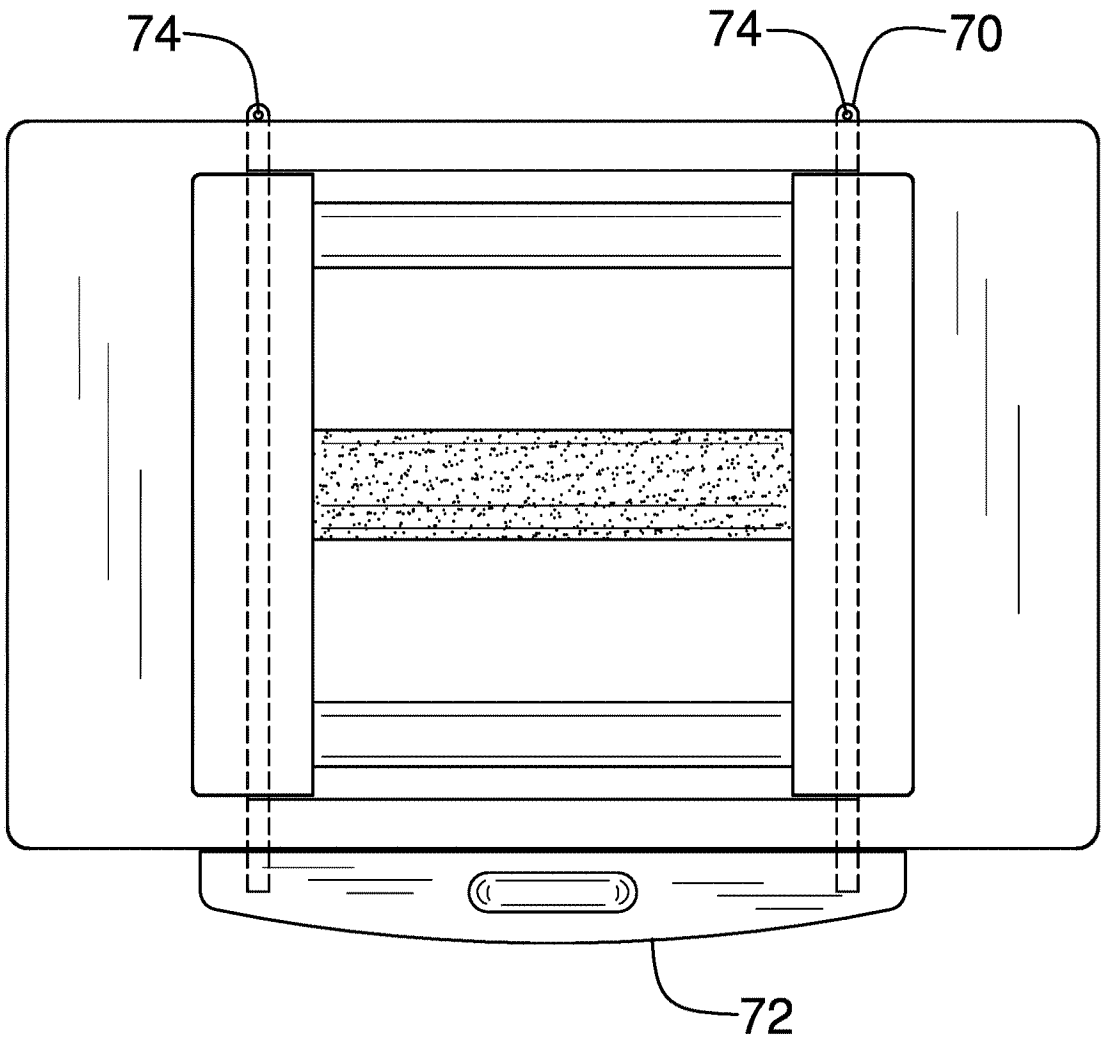
FIG. 8 is a top isometric view of an embodiment of the disclosure.

Each of the weights 12 has a pair of outer edges disposed oppositely from each other to define a first lateral edge 14 and a second lateral edge 16. The weights 12 each have a centrally displaced opening vertically extending there-through to define a receiving space 18. The receiving space 18 of each weight 12 is vertically aligned with the receiving space 18 of each of the other weights 12. The weights 12 may each weigh the same and if using English units may weigh for example, 2.5 lbs., 5.0 lbs., 10.0 lbs. or other typical weight increment found in the weight lifting arts. Should metric units of weights be desired, each weight may be equal to 1.0 kg, 2.5 kg, 5.0 kg, or other conventional weight increments. While the weights 12 will typically all have a same weight defining a standard weight, some embodiments may include one or two weights 12 which are either half or double the standard weight. The cumulative weight of the weights 12 may be indicated by indicia 20 as shown in FIG. 7. However, the indicia 20 instead of displaying numbers may comprise, or also include, color coding to indicate cumulative weight. It should be noted that an uppermost one of the weights 12 may include indicia 12 that is not in a regular increment as the remaining ones of the weights 12. The embodiment of FIG. 7 displays increments of 5.0 lbs. though the uppermost weight begins with 10.0 lbs. This is indicative of other elements of the system 10 being secured to the uppermost one of the weights 12 as will be more fully understood below.

In some embodiments, a distance between the first 14 and second 16 lateral edges of an uppermost one of the plurality of weights 12 is equal to or greater than the distance between the first 14 and second 16 lateral edges of the other weights 12. As such, when viewed from above, only the uppermost one of the weights 12 is viewable. Moreover, the first lateral edges 14 may be aligned with each other and the second lateral edges 16 aligned with each other, as shown in FIG. 7, such that the first lateral edges 14 are aligned with a first vertical plane and the second lateral edges 16 are aligned with a second vertical plane. The weights 12 may each have an identical shape with respect to each other and having linear first 14 and second 16 lateral edges. However, first 14 and second 16 lateral edges may be formed with varying shapes. Alternatively, the distance from the first 14 and 16 lateral edges of the uppermost one of the weights may be equal to the distance between the first 14 and second 16 lateral edges of only some of the weights 12 should the stack of weights 12 have lateral edges, as a whole, which are staggered. In such embodiments a lowermost one of the weights 12 may be viewable from above the system 10. Other embodiments may include the distance between the first 14 and second 16 lateral edges decreases from the uppermost one of the weights 12 to a lowermost one of the weights 12, or this distance increases from the uppermost one of the weights to the lowermost one of the weights.

More particularly, each of the weights 12 includes a pair of plates 22, 24 spaced laterally from each other. One of the plates 22 includes the first lateral edge 14 and one of the plates 24 includes the second lateral edge 16. The plates 22, 24 are each horizontally orientated and lie in a common horizontal plane with respect to each other. While the plates 22, 24 may instead be arcuate, from the receiving space 18 to a corresponding first 14 or second 18 lateral edge, a planar shape would typically be more efficient in construction. The plates 22, 24, as shown in the Figures, may include an internal mass 26 comprising a metal, such as iron, or other high density material which is then encapsulated in a coating 28 of a shock absorbent, scuff-resistant material such as plastics, elastomers and the like. The plates 22, 24 of the preferred embodiments have both a length and a width, in a horizontal plane, that are greater than a height of the plates 22, 24.

A pair of arms 30, 32 is each attached to and extends between the plates 22, 24. The receiving space 18 is defined and is bound by the plates 22, 24 and the arms 30, 32.

Figure 4:
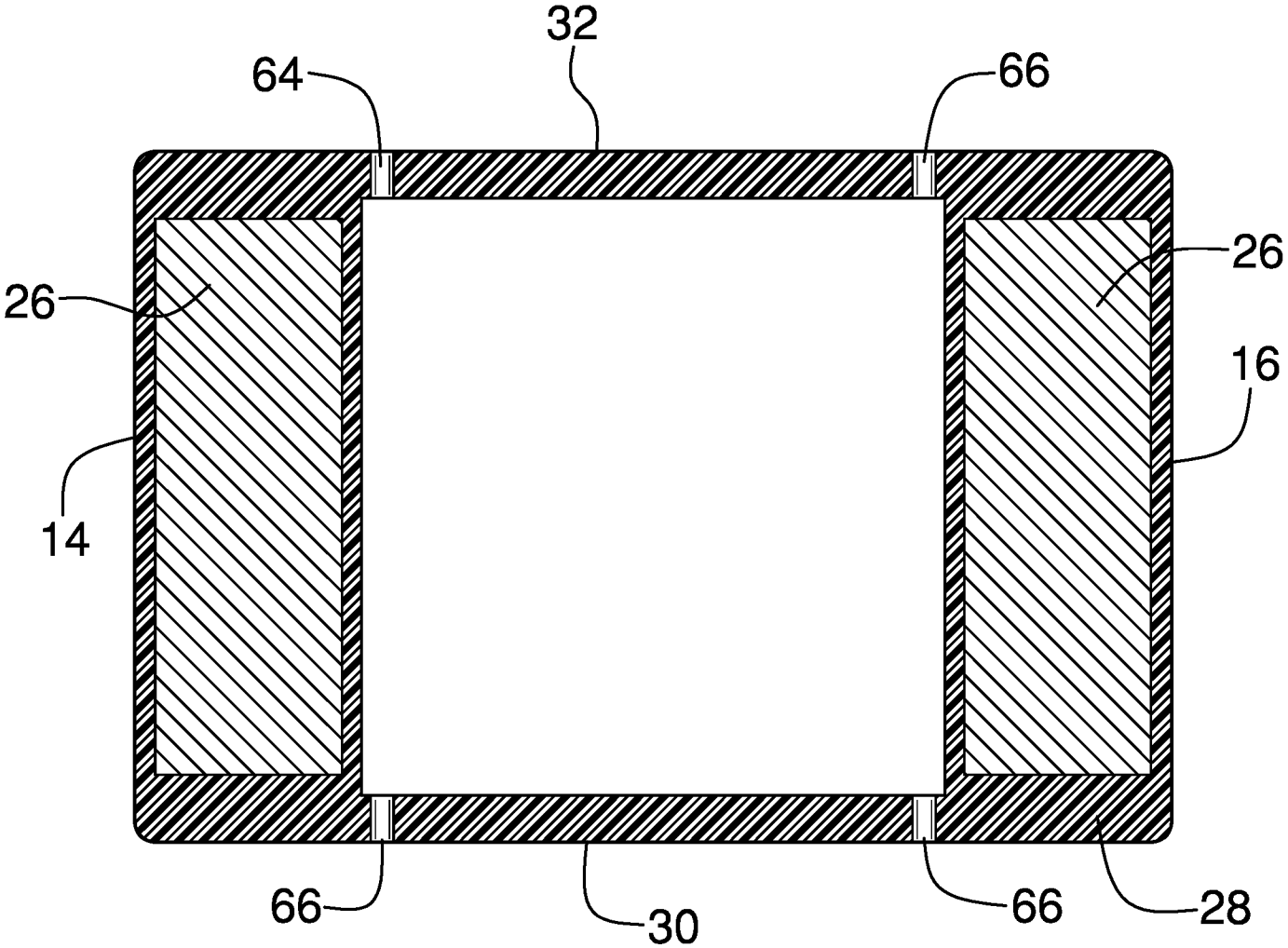
FIG. 4 is a cross-sectional view of an embodiment of the disclosure taken along line 4-4 of FIG. 2.
Figure 5:
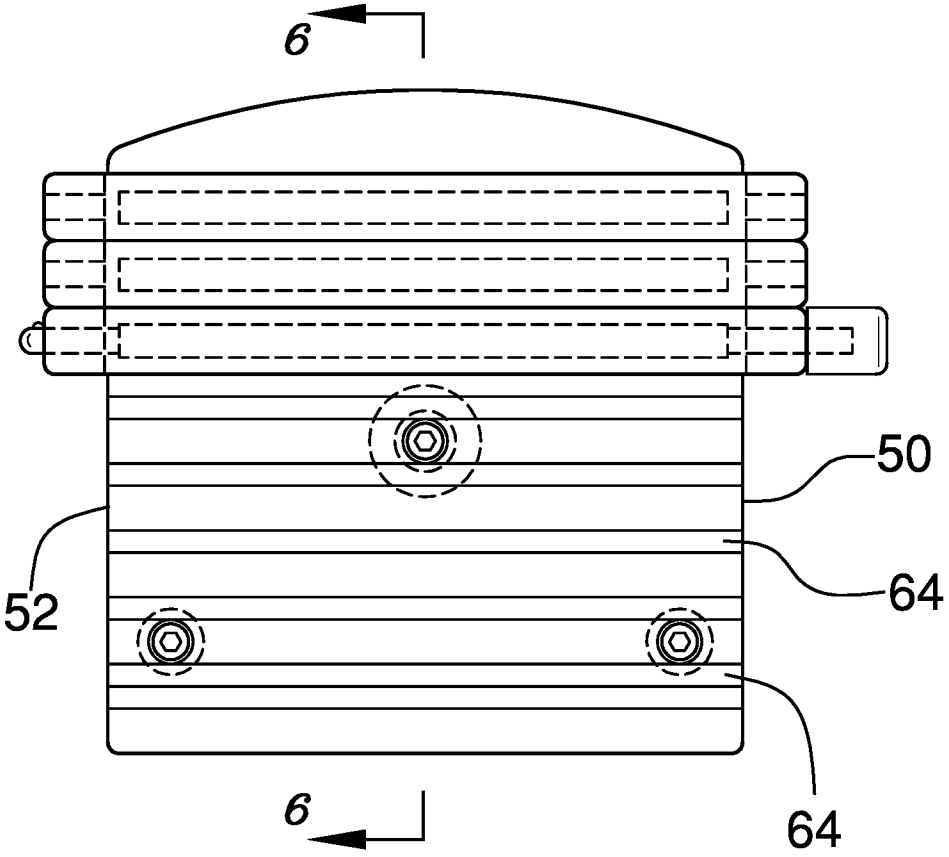
FIG. 5 is a side view of an embodiment of the disclosure.

The arms 30, 32 may be covered with the coating 28 such that the weight 12 appears as a unitary structure. The arms 30, 32 may be comprised of a slightly flexible material for shock absorbing purposes though rigid materials, such as metals may be utilized. The method of coupling the arms 30, 32 to the plates 22, 24 is not crucial to the system 10. Thus, the arms 30, 32 may be secured to the plates 22, 24 using conventional couplers including screws, or formed from the coating 28 itself, as is shown in FIG. 4. Alternatively, the arms 30, 32 may be mechanically coupled to the internal mass such as by welding, fasteners and the like, and the coating 28, if used, may be applied after the arms 30, 32 are secured to the internal mass 26.

A handle 34 is removably extendable into the receiving space 18 and is securable to selected ones of the weights 12 to allow the system 10 to function as a dumbbell. A coupler 36 releasably engages a selected one of the weights 12 to the handle 34 and defines a coupled weight 38. The coupled weight 38 and each of the weights 12 positioned above the coupled weight 38 is releasably secured to the handle 34 and each of the weights 12 positioned below the coupled weight 38 are disengaged from the handle 34. In this manner, the user can select the number of weights 12 to be supported on the handle 34 and thereby be usable weight for a particular exercise.

In an embodiment shown in the Figures and in particular FIG. 1, the handle 34 includes a first lateral panel 40 and a second lateral panel 42. Each of the first 40 and second 42 lateral panels is vertically orientated. The first 40 and second 42 lateral panels each have an inner surface 44, an outer surface 46 and a perimeter edge 48. The perimeter edge 48 includes a front edge 50 and a rear edge 52 positioned oppositely of each other, as well as a top edge 54 and bottom edge 56. The top edges 54 may each include a shoulder 58 wherein the shoulders 58 extend in opposite directions with respect to each other to extend over the weights 12. The shoulders 58 form stops to stabilize the weights 12 between the shoulders 58 and coupler 36 when the system 10 is being used during different exercises. Materials used for the first 40 and second 42 lateral panels may be varied but will typically include high strength, generally rigid materials formed of plastics or metals.

Figure 6:
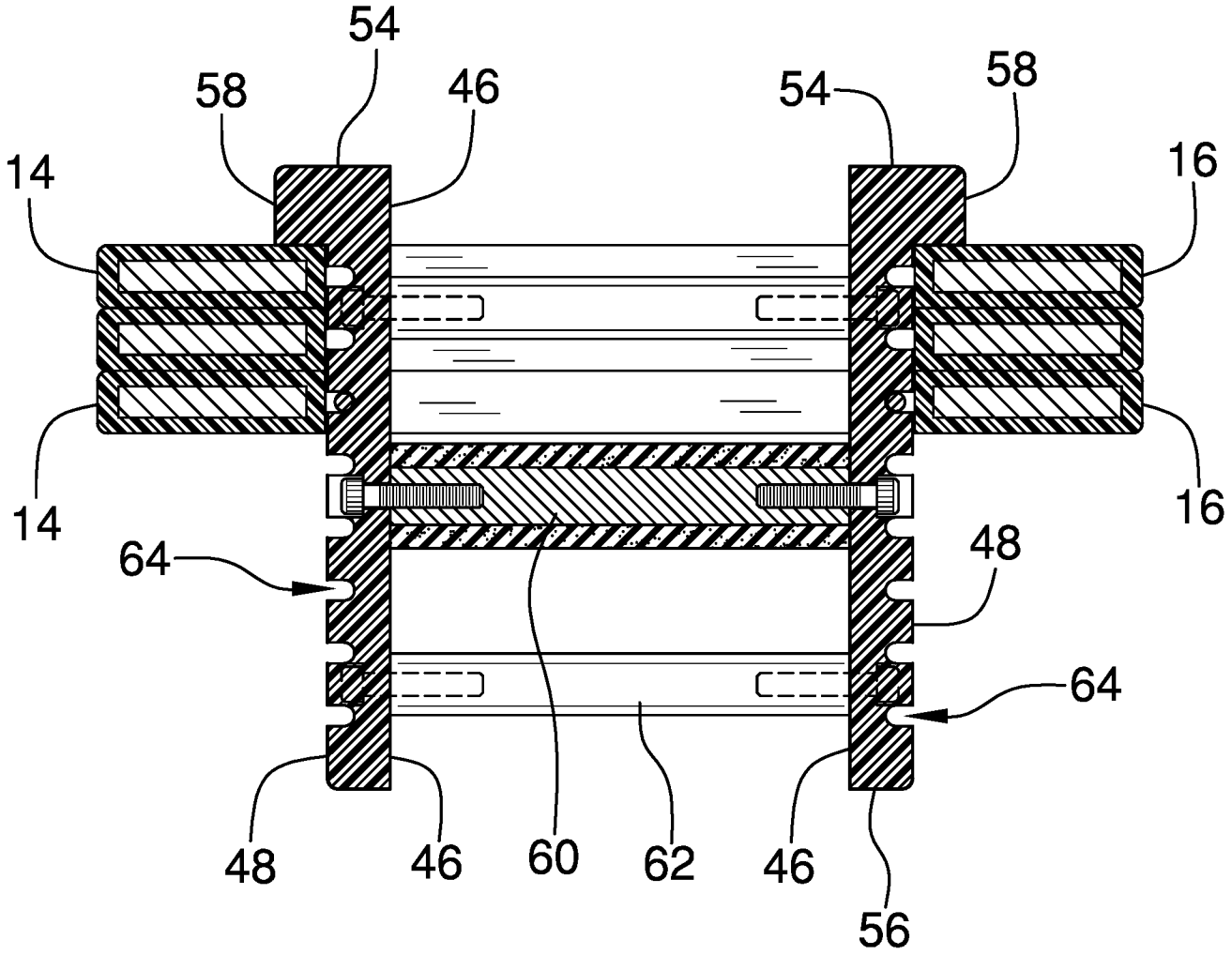
FIG. 6 is a cross-sectional view of an embodiment of the disclosure taken along line 6-6 of FIG. 5.

A grip 60 is attached to and extends between the inner surfaces 44 of the first 40 and second 42 lateral panels. The grip 60 will typically be centrally located on the first 40 and second 42 lateral panels and secured in such a manner that the perimeter edges 48 of the first 40 and second 42 lateral panels is aligned with each other. As can be seen in FIG. 6, the grip 60 may include multiple components such as a central post of rigid material that is coated in a grip enhancing material which may also have resiliently compressible characteristics. Elastomers and foams may be preferred grip enhancing materials. While FIG. 6 shows the grip 60 secured to the first 40 and second 42 lateral panels, the grip may be formed as a unitary structure with the first 40 and second 42 lateral panels and thereafter, if desired, furnished with the grip enhancing material. A plurality of stabilizing rods 62 may extend between and be attached to the first 40 and second 42 lateral panels to stabilize the first 40 and second 42 lateral panels relative to each other. While the rods 62 may include four rods 62 as shown in the Figures, some embodiments may only include a pair of rods 62 positioned near the bottom edge 56.

The front edges 50 each have a plurality of receivers 64 therein that are disposed in vertical alignment with each other. Each of the receivers 64 in one of the front edges 50 is horizontally aligned with one of the receivers 64 in the other one of the front edges 50 to define a pair of receivers 64. The receivers 64 are positioned such that each pair of receivers 64 is aligned with one of the weights 12 as is best shown in FIG. 6. The receivers 64 may comprise a tunnel extending through an entirety of the first 40 and second 42 lateral panels and outwardly through the rear edges 52. Alternatively, as can be seen in the Figures, the receivers 64 may comprise horizontally orientated grooves positioned in the outer surfaces 46 where the grooves extend through the front 50 and rear 52 edges.

Figure 2:
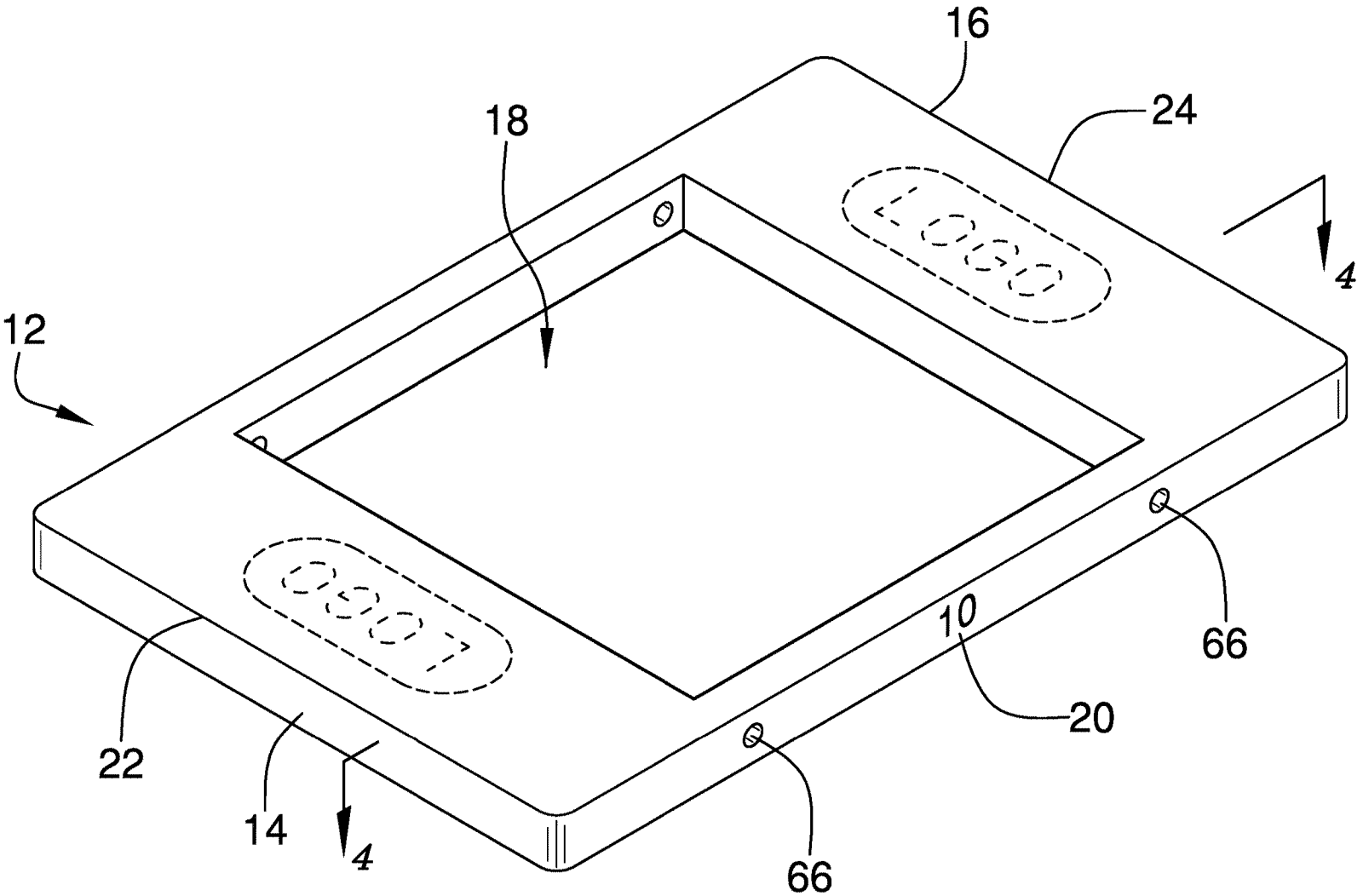
FIG. 2 is a top isometric view of a weight of an embodiment of the disclosure.
Figure 3:
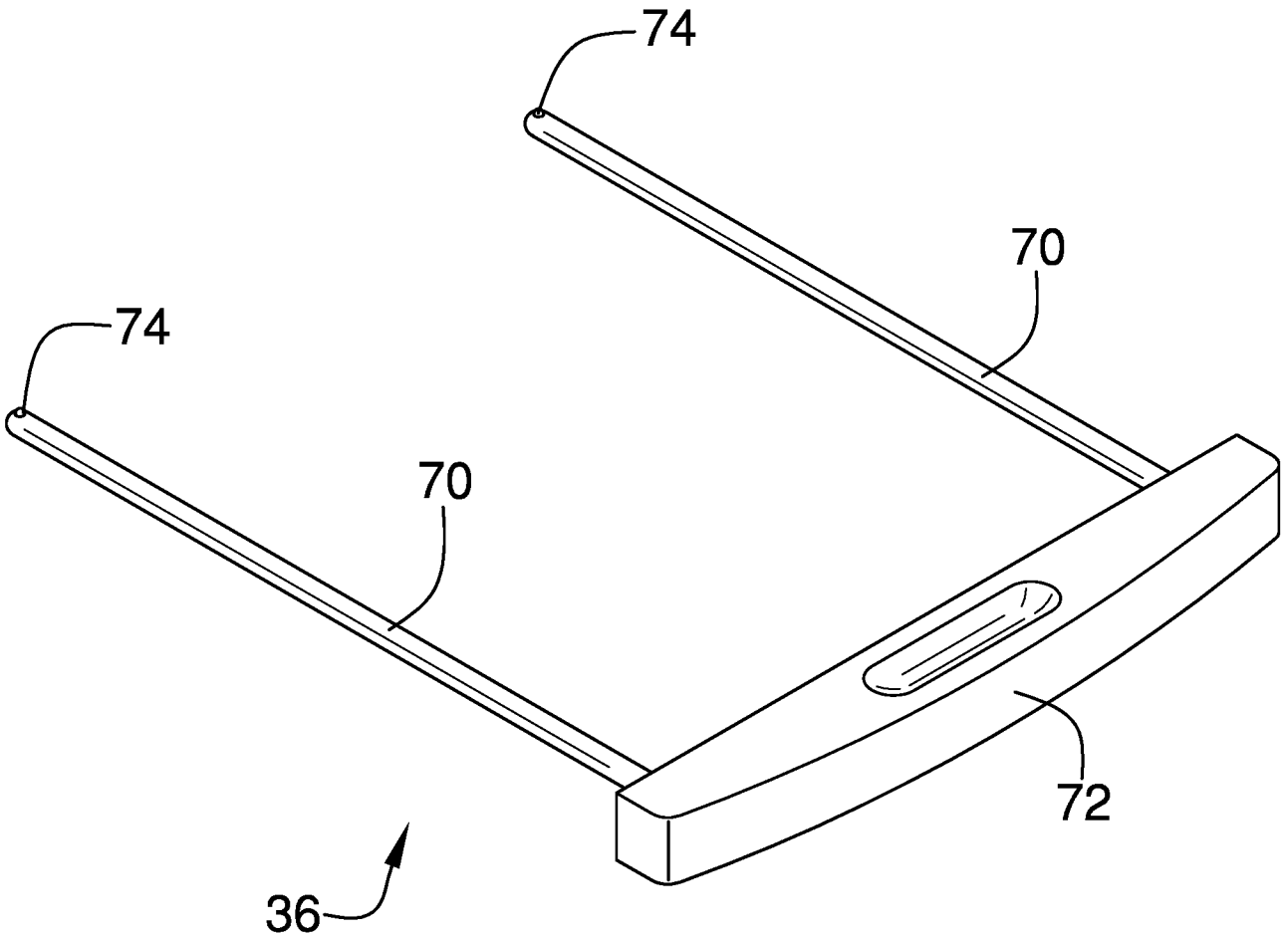
FIG. 3 is a top isometric view of a coupler of an embodiment of the disclosure.

For descriptive purposes and as best shown in FIGS. 2 and 4, in one embodiment the arms front 30, 32 of the weights 12 each include a front arm 30 and a rear arm 32 wherein the front arm 30 is positioned adjacent to the front edges 50 of the first 40 and second 42 lateral panels. The front arm 30 and rear arm 32 of each of the weights 12 may each include a pair of apertures 66 wherein each of the apertures 66 is aligned with one of the receivers 64 such that a pair of channels is defined each including one aperture 66 in the front arm 30, one receiver 64, and one aperture in the rear arm 34.

Figure 14:
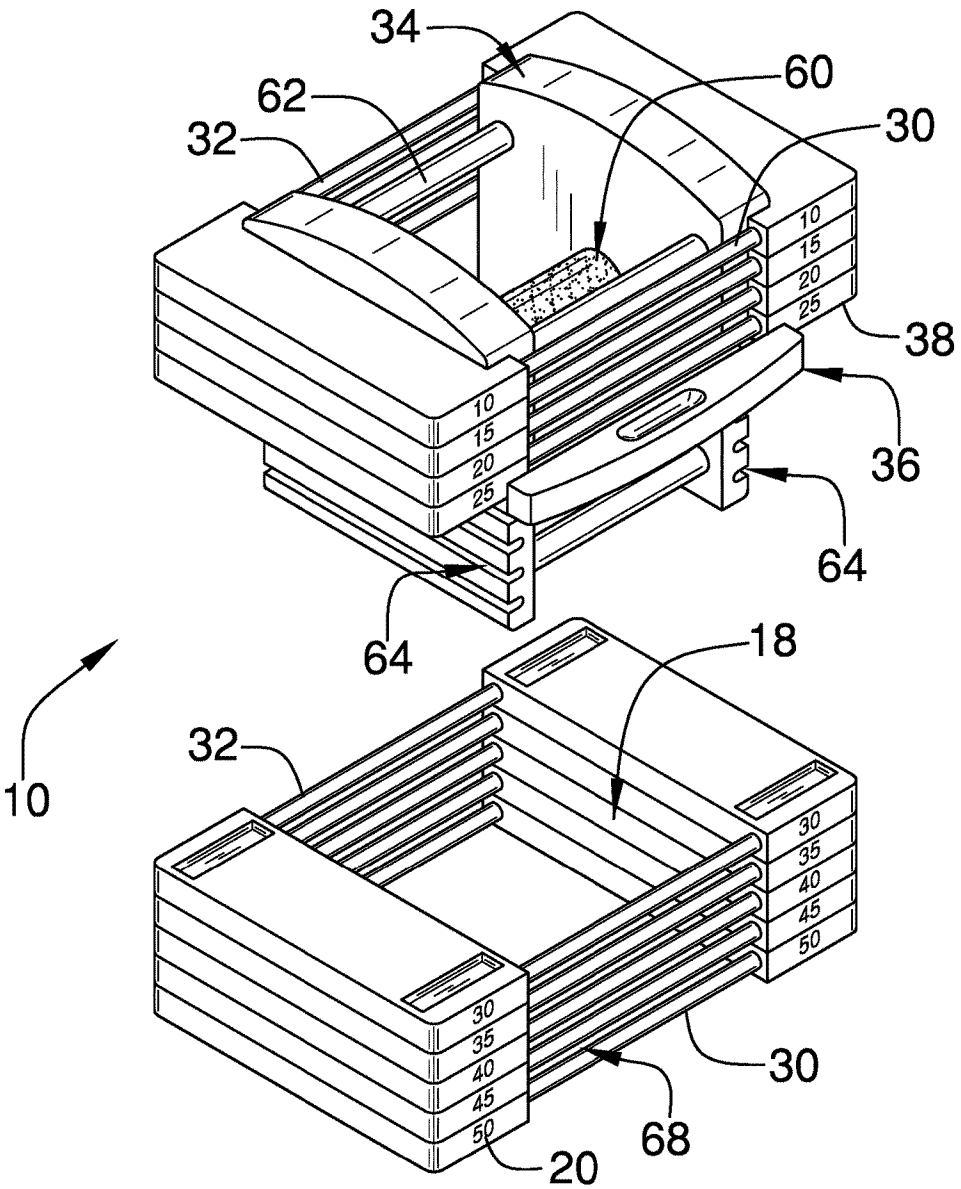
FIG. 14 is a front isometric view of the embodiment of FIG. 11 of the disclosure.
Figure 15:
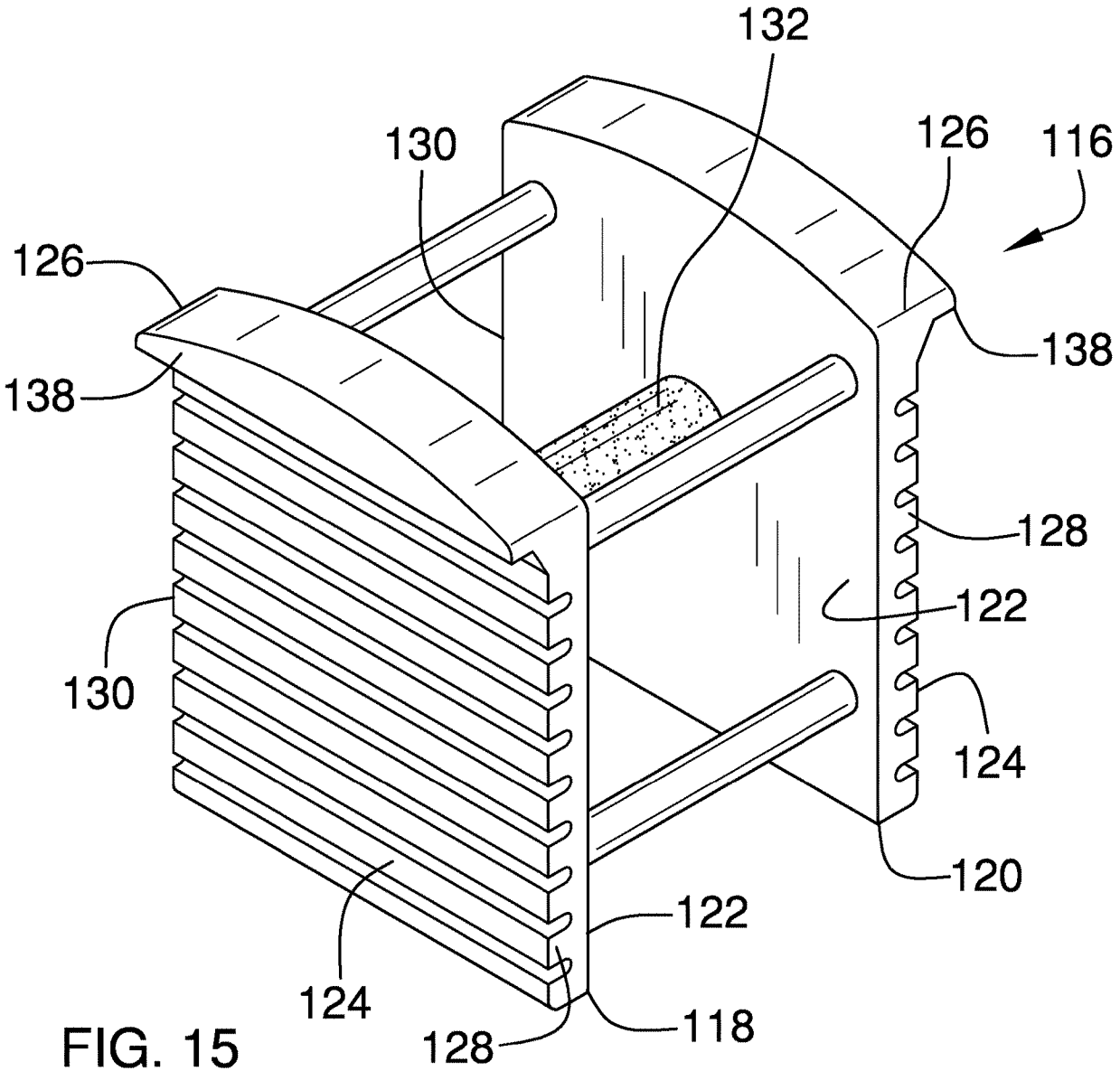
FIG. 15 is a front isometric view of a handle of a dumbbell system according to an embodiment of the disclosure.

In another embodiment, shown in FIGS. 11-14, the front 30 and rear 32 arms do not include apertures 66. However, a gap 68 is formed between adjacent ones of front arms 30 and adjacent ones of the rear arms 32. This allows the coupler to extend under the front 30 and rear 32 arms of a selected one of the weights 12 to allow the coupler to engage the receivers. The front 30 and rear 32 arms are then seated upon the coupler as is shown in FIG. 14.

The coupler 36 may include a pair of tines 70 attached to a handhold 72. The tines 70 are extendable through the apertures 66 in one of the front arms 30 and aligned ones of the receivers 64 and thereafter through the aligned apertures 66 in the associated one of the rear arms 32. Alternatively, the tines are extended under the front 30 and rear 32 arms of a selected weight while engaging the associated one of the receivers 34. The weight 12 engaged with the tines 70 defines the coupled weight 38. As should be understood in the Figures, all weights 12 positioned above the tines 70 are secured to the in place between the coupled weight 38 and the shoulders 58. The coupler 36 may include features that prevent its accidentally sliding out of the receivers 64. For example, one such structure may include detents 74 positioned on the tines 70 distal to the handhold 72. Yet another retaining featured may include the handhold 72 and/or front arms 30 incorporating magnetic elements retaining the handhold 72 in abutment with the weights 12, or mating members on the handhold 72 and weight may frictionally or snappily engage each other. Alternatively, elastic cordage, attached to the coupler 36, may be utilized to continuously pull the coupler 36 into an engaged condition with the handle 34.

To prevent the weights 12 from sliding off of each other while stacked, the weights may include mating members with a first mating member 76 positioned on a lower surface 78 of each weight 12 and a second mating member 80 positioned on an upper surface 82 of each weight 12. In one embodiment shown in FIG. 12, the first 76 and second 80 mating members may include mating raised and trough sections.

In use, when the grip 60 is lifted, the handle 34, coupler 36, coupled weight 38 and all weights 12 there above are lifted upwardly such that the weights 12 below the coupled weight 38 are left behind. In this manner the user can select the total weight to be used for a particular exercise. The system 10 will be therefore be useful for all exercises dumbbells are commonly used for using one system 10 to take the place of numerous individual dumbbells.

An alternate embodiment of the system 10 is found in FIGS. 15-23. As with the embodiment of FIGS. 1-14, this embodiment includes a plurality of weights 90 vertically stackable on top of each other. Each of the weights 90 has a pair of outer edges disposed oppositely from each other to define a first lateral edge 92 and a second lateral edge 94. The weights 90 each have a centrally positioned opening vertically extending therethrough and defining a receiving space 96. The receiving space 96 of each weight 90 is vertically aligned with the receiving space 96 of each of the other weights 90. Each of the weights 90 has a center of mass and the center of mass of each weight 90 is positioned above the center of mass of a next adjacent weight positioned there-below such that center of masses of all of the weights 90 are vertically spaced from each other.

Figure 10:
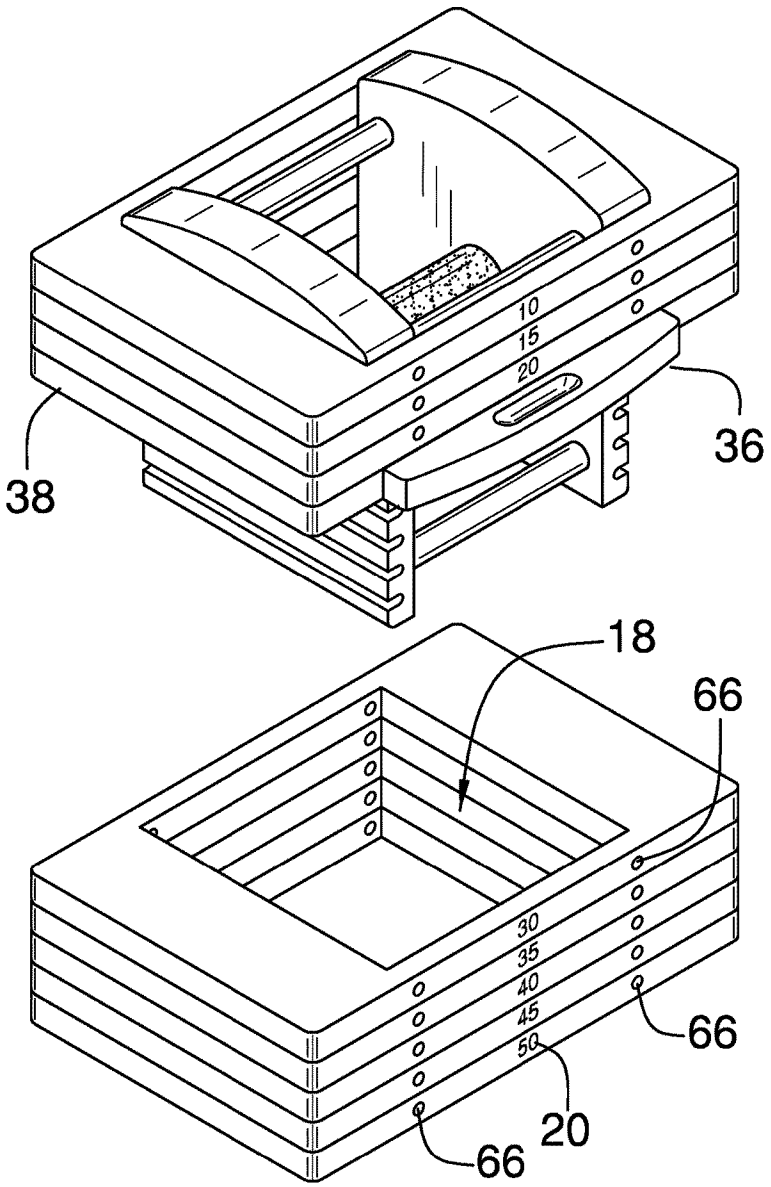
FIG. 10 is a front isometric view of an embodiment of the disclosure.
Figure 11:
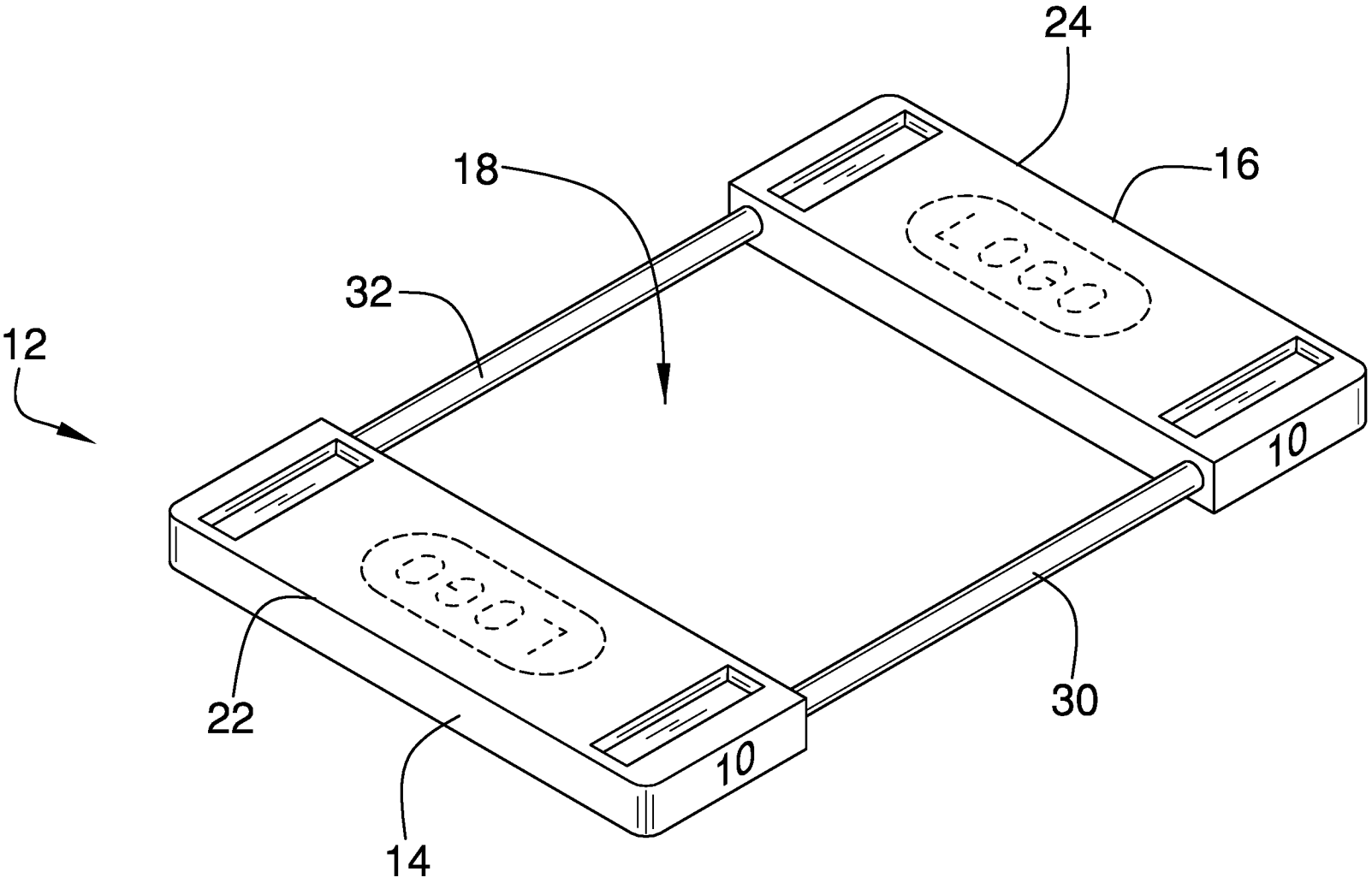
FIG. 11 is a front isometric view of an embodiment of the disclosure.
Figure 12:
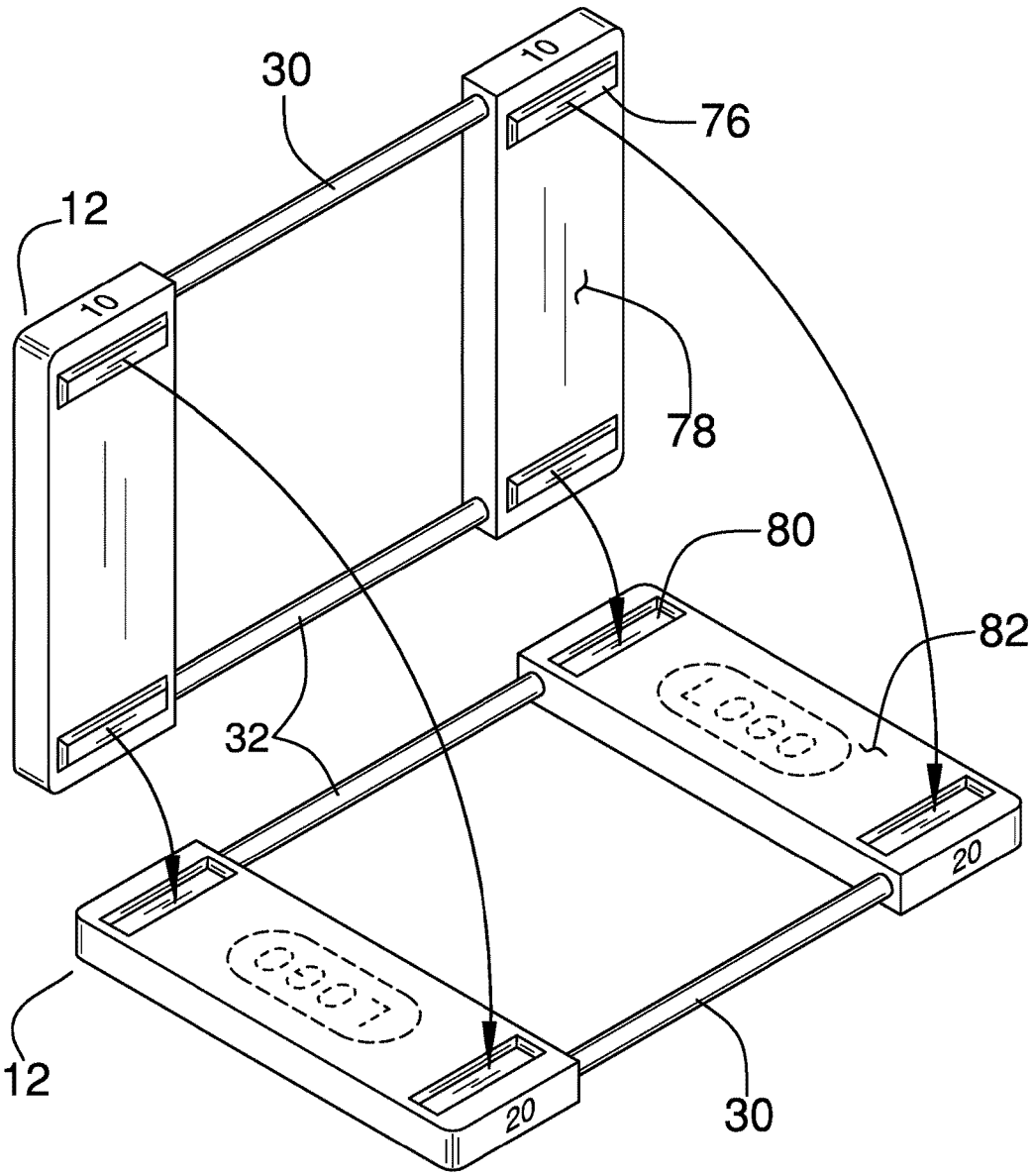
FIG. 12 is a front isometric view of the embodiment of FIG. 11 of the disclosure.
Figure 13:
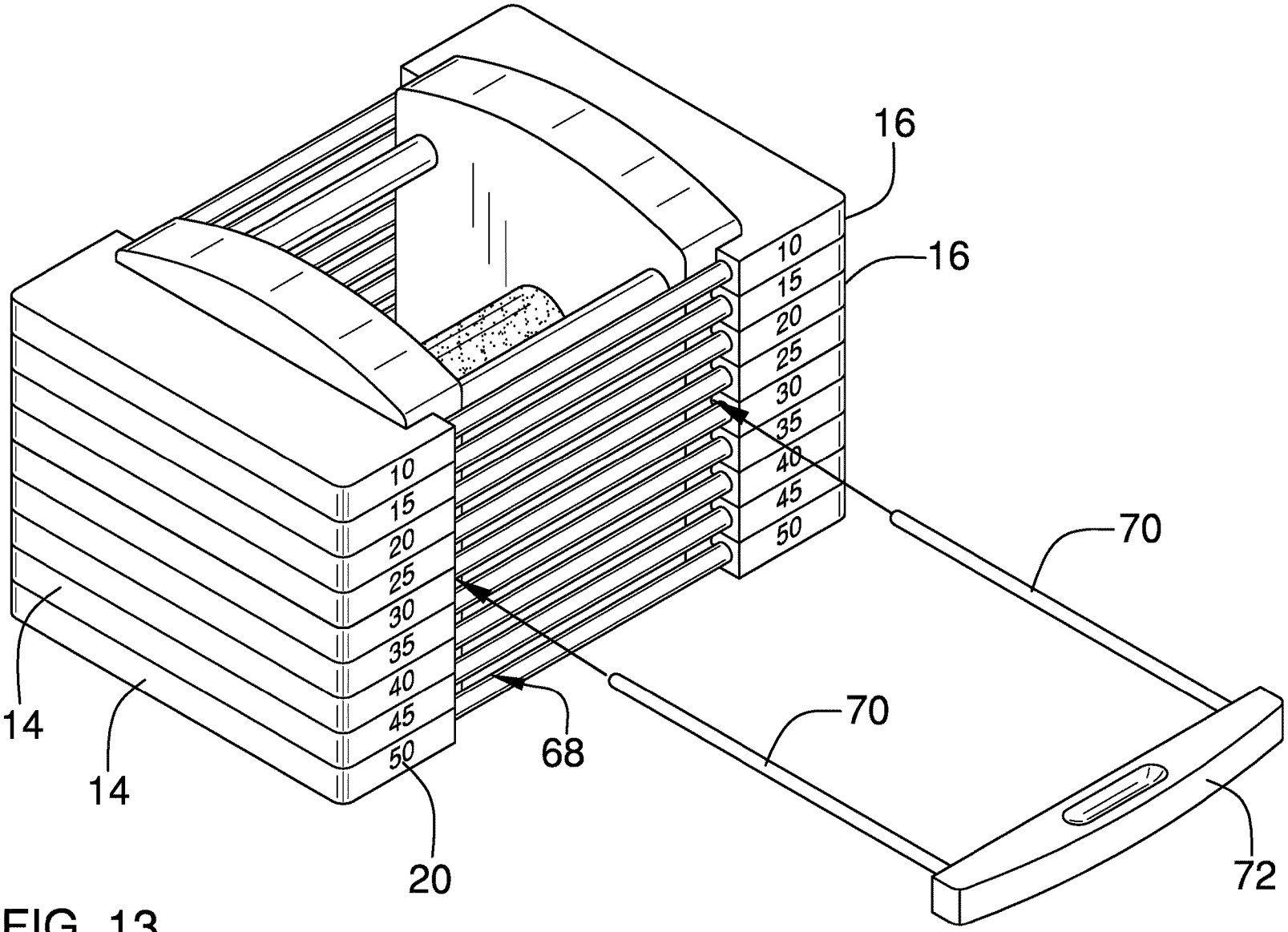
FIG. 13 is a front isometric view of the embodiment of FIG. 11 of the disclosure.
Figure 16:
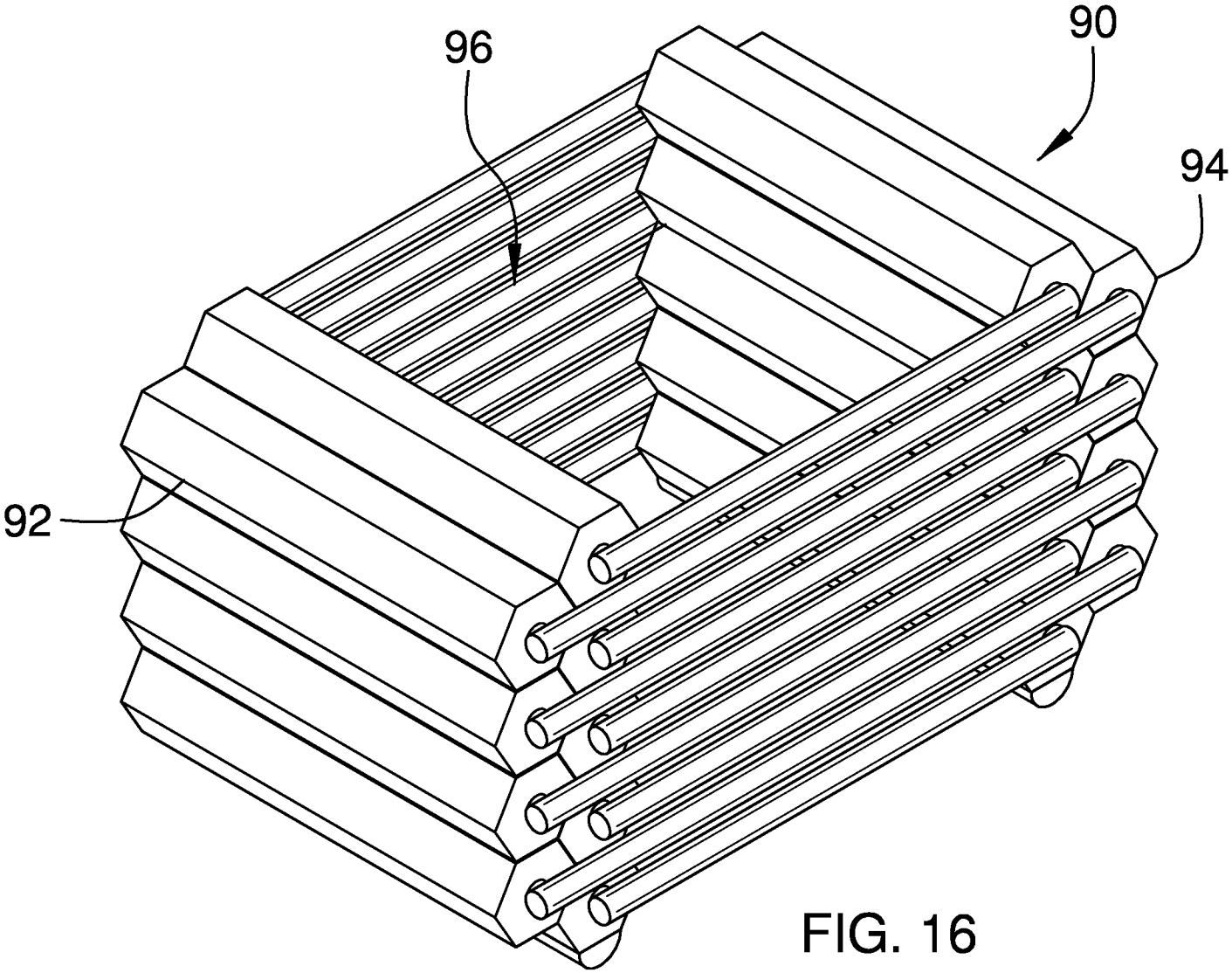
FIG. 16 is a top isometric view of a plurality of weights of an embodiment of the disclosure.
Figure 17:
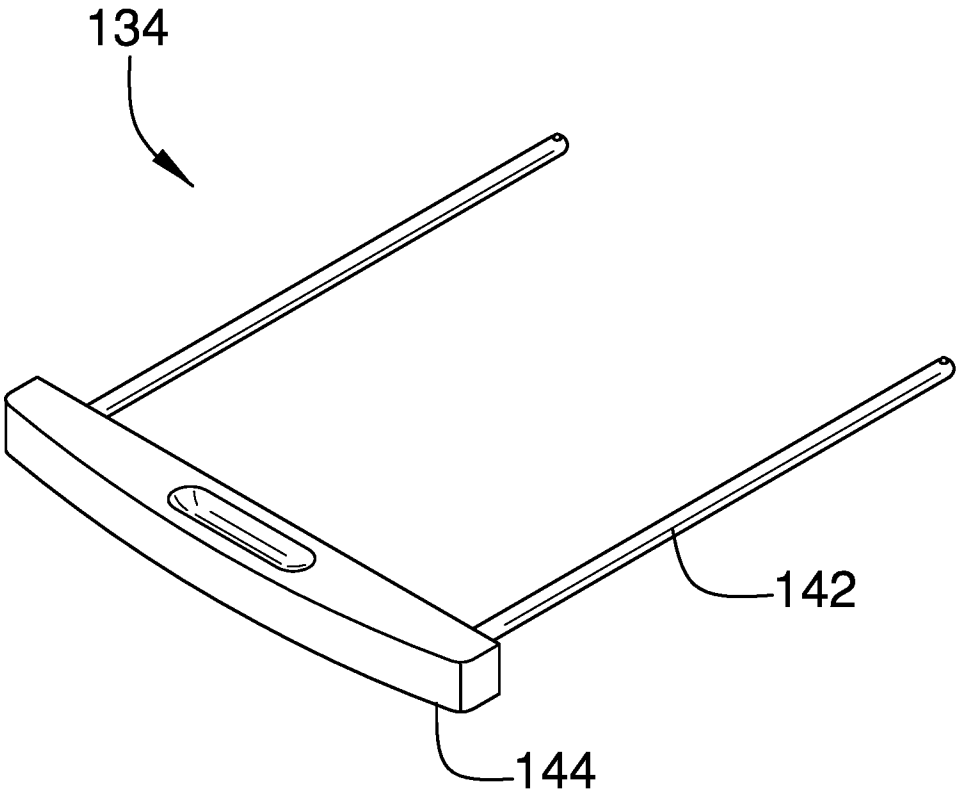
FIG. 17 is a top isometric view of an embodiment of an alternate coupler of the disclosure.
Figure 18:
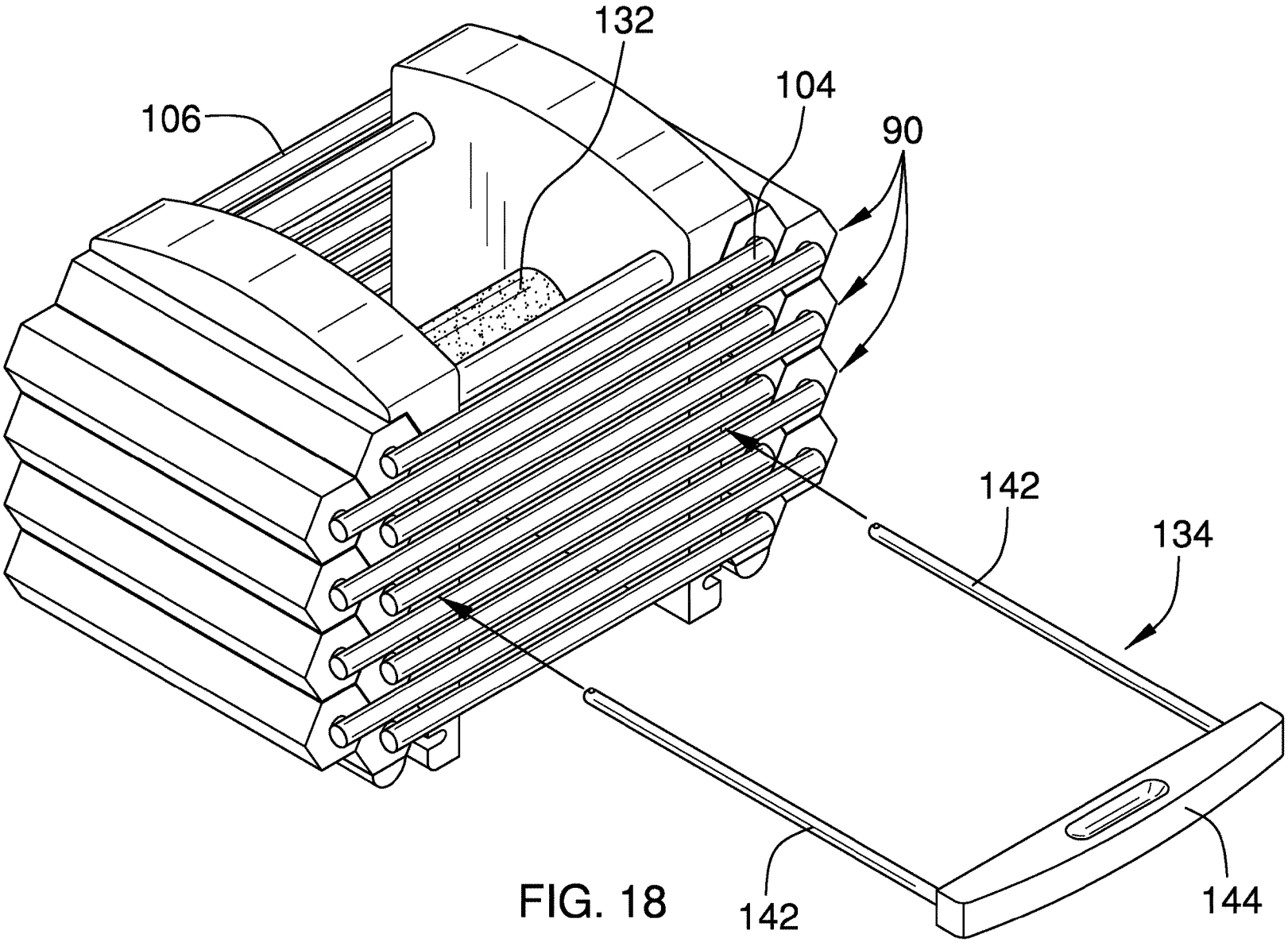
FIG. 18 is a side and top isometric view of an embodiment of the disclosure showing the weights of FIG. 16.

As with FIG. 10, FIG. 16 discloses weights 90 each having a generally planar design wherein the structure of the weights 90 radiates outwardly from the receiving space 96 and therefore the center of mass is located between horizontally parallel planes bounding each weight 90. Since the weights 90 are stacked on top of each other, the center of masses must also be vertically "stacked" on top of each other. In some embodiments the center of masses of the weights 90 are vertically aligned with each other and may, more particularly, be located in a central area of the respective receiving space 90.

Figure 21:
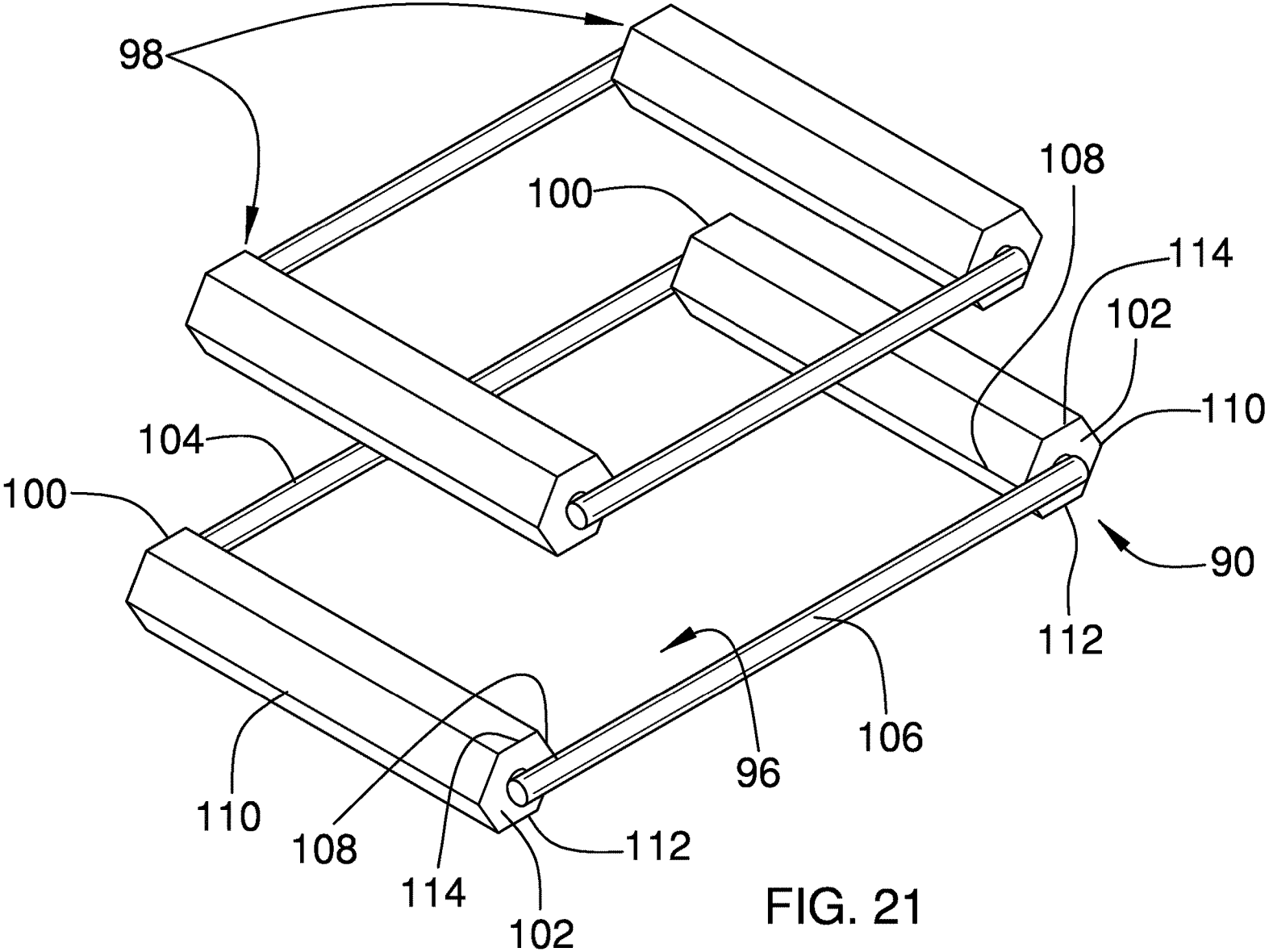
FIG. 21 is a rear isometric view of an embodiment of the disclosure including weights having a hexagonal shape.
Figure 22:
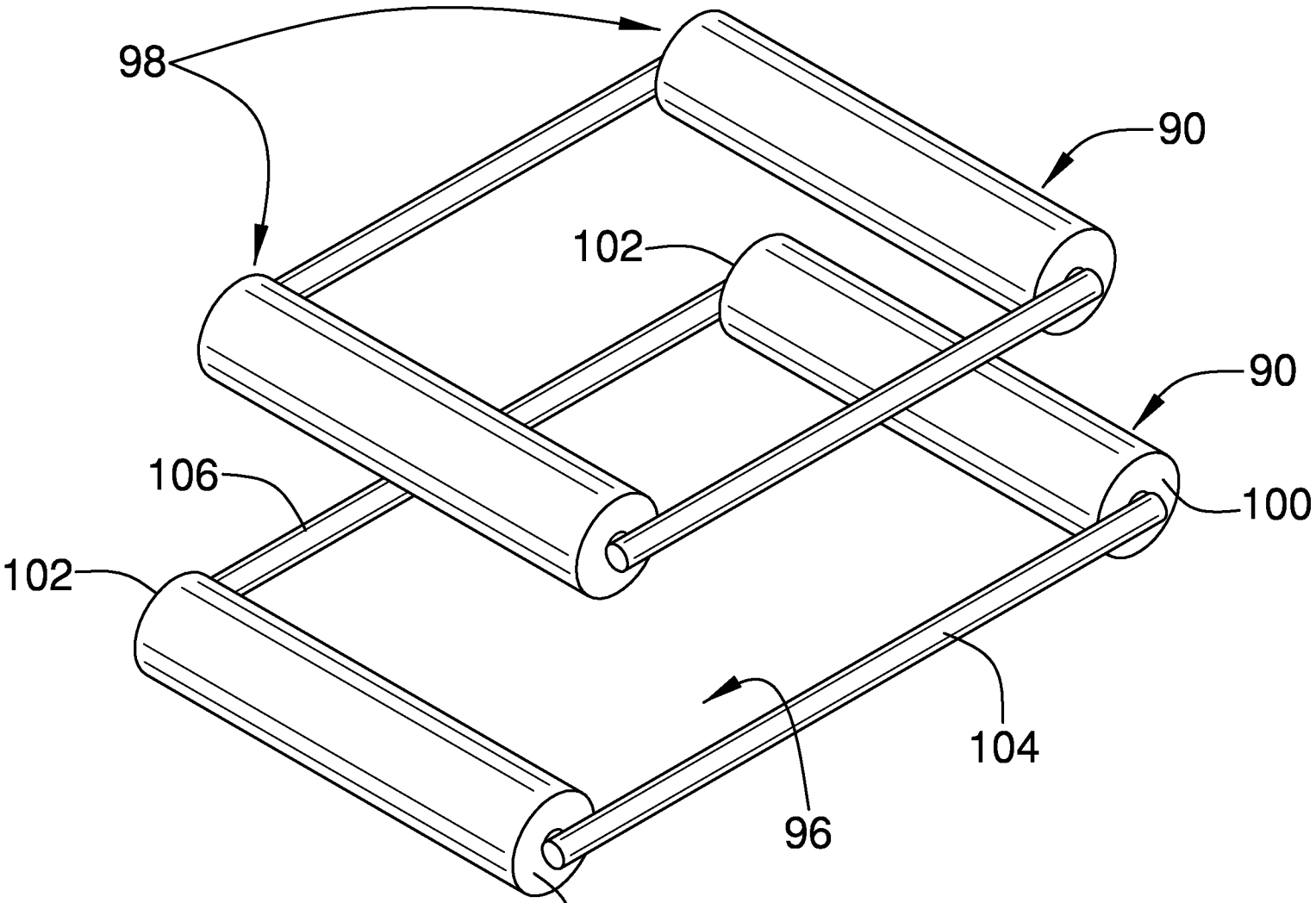
FIG. 22 is a front isometric view of an embodiment of the disclosure including weights having a cylindrical shape.

The embodiment of FIGS. 15 through 23 includes weights 90 each having a pair of bodies 98 laterally spaced from each other. The bodies 98 of each weight 90 will typically have a same shape and size relative to each other and one of the bodies 90 includes the first lateral edge 92 and one of the bodies 98 includes the second lateral edge 94. Each of the bodies 98 has a front side 100 and a rear side 102. A pair of arms, comprising a front arm 104 and a rear arm 106, is each attached to and extends between the bodies 98. The receiving space 96 is defined and bound by the bodies 98 and the arms 104, 106. The arms 104, 106, as can be seen in FIGS. 21 and 22, may be attached to the respective front 100 and rear 102 sides of the weight 90 bodies 98. The arms 104, 106 may be secured to the bodies 98 using any conventional means including welding, fasteners, chemical adhesive bonding and the like. The bodies 98 may be comprised of conventional materials used for providing mass in an exercise weight. Generally the bodies 98 will be comprised of a metal and may be coated with a plastic or elastomeric material. The arms 104, 106 may or may not be comprised of the same material as the bodies 98, and the arms 104, 106 and bodies 98 may further be provided as a unitary structure.

With further respect to the bodies 98, and as best shown in FIG. 21, each body 98 has an interior edge 108 facing the receiving space 96, a distal edge 110 positioned opposite the interior edge 108, a lower edge 112, and an upper edge 114 positioned opposite of the lower edge 112. A distance from the lower edge 112 to the upper edge 114 defines a height dimension, a distance from the interior edge 108 to the distal edge 110 defines a width dimension, and a distance from the front side 100 to the rear side 102 defining a depth dimension. The depth dimension is greater than either of the width and height dimensions. More specifically, the depth dimension is greater than the sum of the width and height dimensions, and therefore the bodies 98 are each elongated front the front side 100 to the rear side 102. In some embodiments of the bodies, the height and width dimensions are equal to each other. Generally, the bodies 98 may be provided in a tubular shape.

The bodies 98 of this embodiment have a cross-section, taken perpendicular to a line extending through each of the associated front 100 and rear 102 sides, having a geometric shape. The geometric shape may be a regular geometric shape and include, for example, triangles, rectangles, pentagons, hexagons, octagons, parallelograms, rhombuses, circles, and ovals. The geometric shape may be selected on its ability to properly nest and form a stable configuration throughout movements encountered while performing exercise movements typically associated with dumbbells. FIG. 21 depicts a hexagonal version of the bodies 98 while FIG. 21 includes a circular shape.

Figure 9:
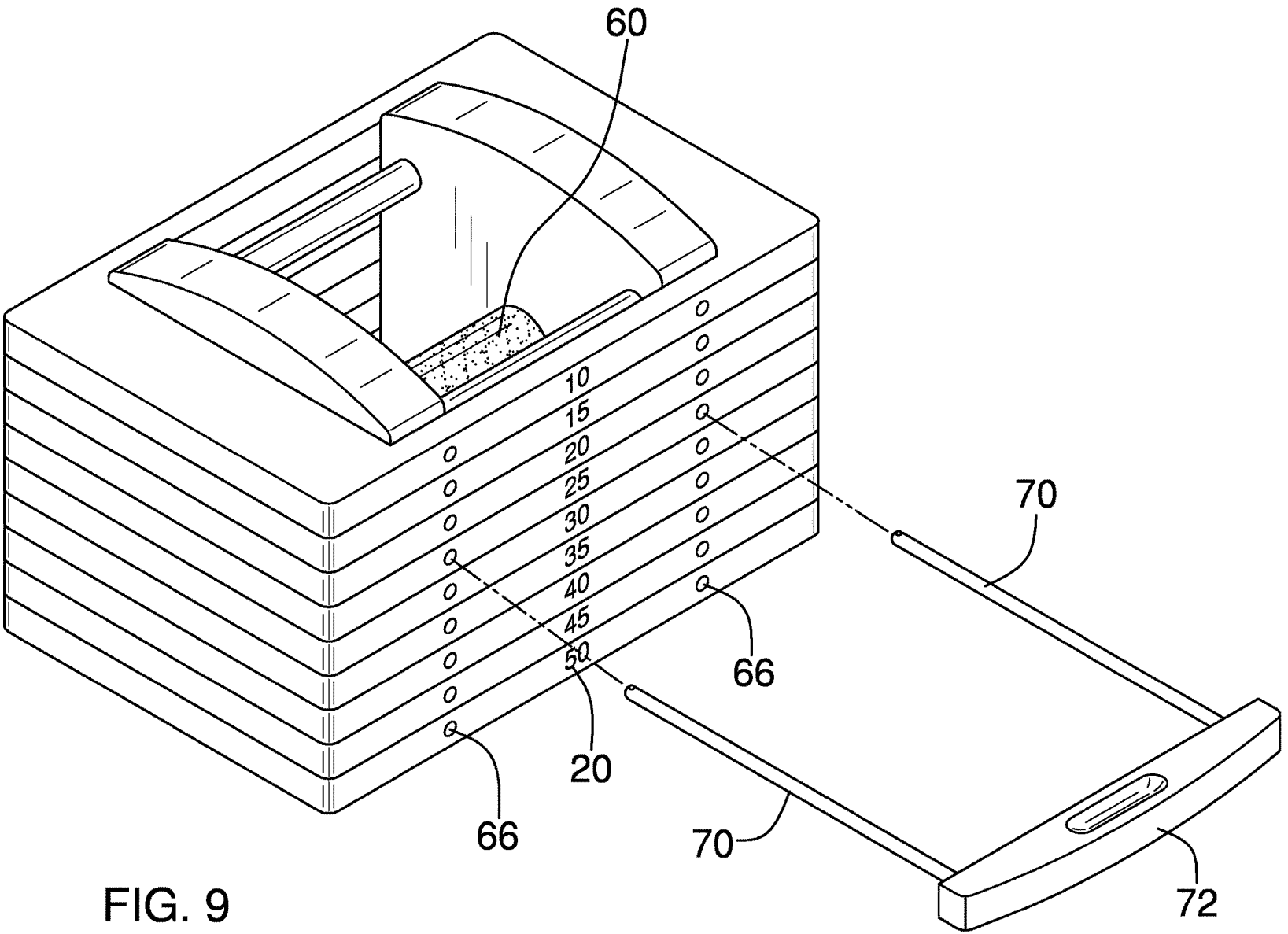
FIG. 9 is a front isometric view of an embodiment of the disclosure.

As with the embodiments disclosed above in FIG. 9, a distance between the first 92 and second 94 lateral edges of an uppermost one of the plurality of weights 90 is equal to or greater than a distance between the first 92 and second 94 lateral edges of the other weights 90. More typically, the distance between the first 92 and second 94 lateral edges of an uppermost one of the plurality of weights 90 is equal to or greater than the distance between the first 92 and second 94 lateral edges of at least two of the other weights 90. In other embodiments, the distance between the first 92 and second 94 lateral edges of an uppermost one of the plurality of weights 90 is equal to or less than the distance between the first 92 and second 94 lateral edges of at least two of the other weights 90. In yet another embodiment of the system 10, the first lateral edges 92 are aligned with each other and the second lateral edges 94 are aligned with each other such that the first lateral edges 92 are aligned with a first vertical plane and the second lateral edges 94 are aligned with a second vertical plane.

Figure 19:
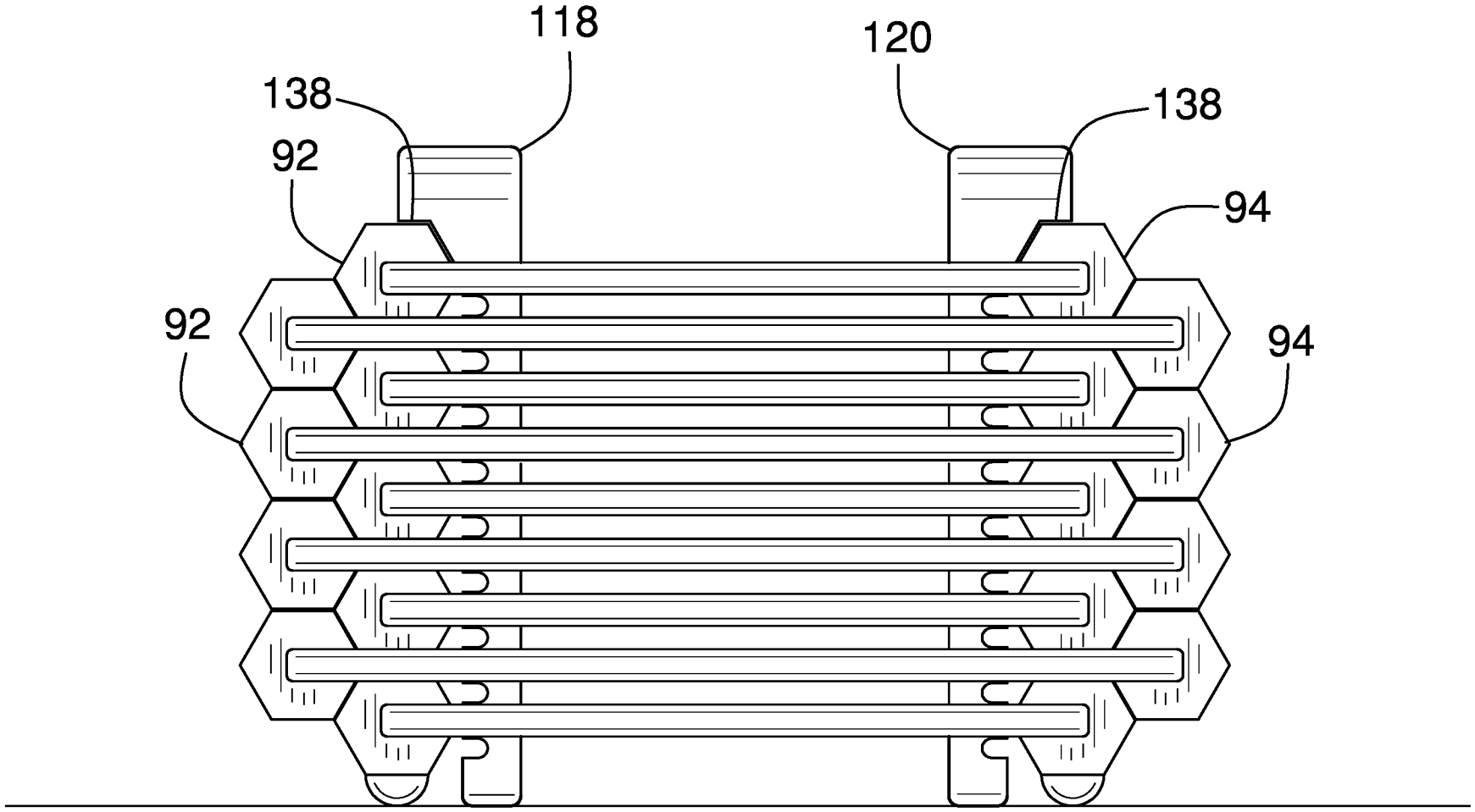
FIG. 19 is a back view of an embodiment of the disclosure showing the weights and handle of FIGS. 15 and 16 and being a mirror image of a front view thereof.
Figure 20:
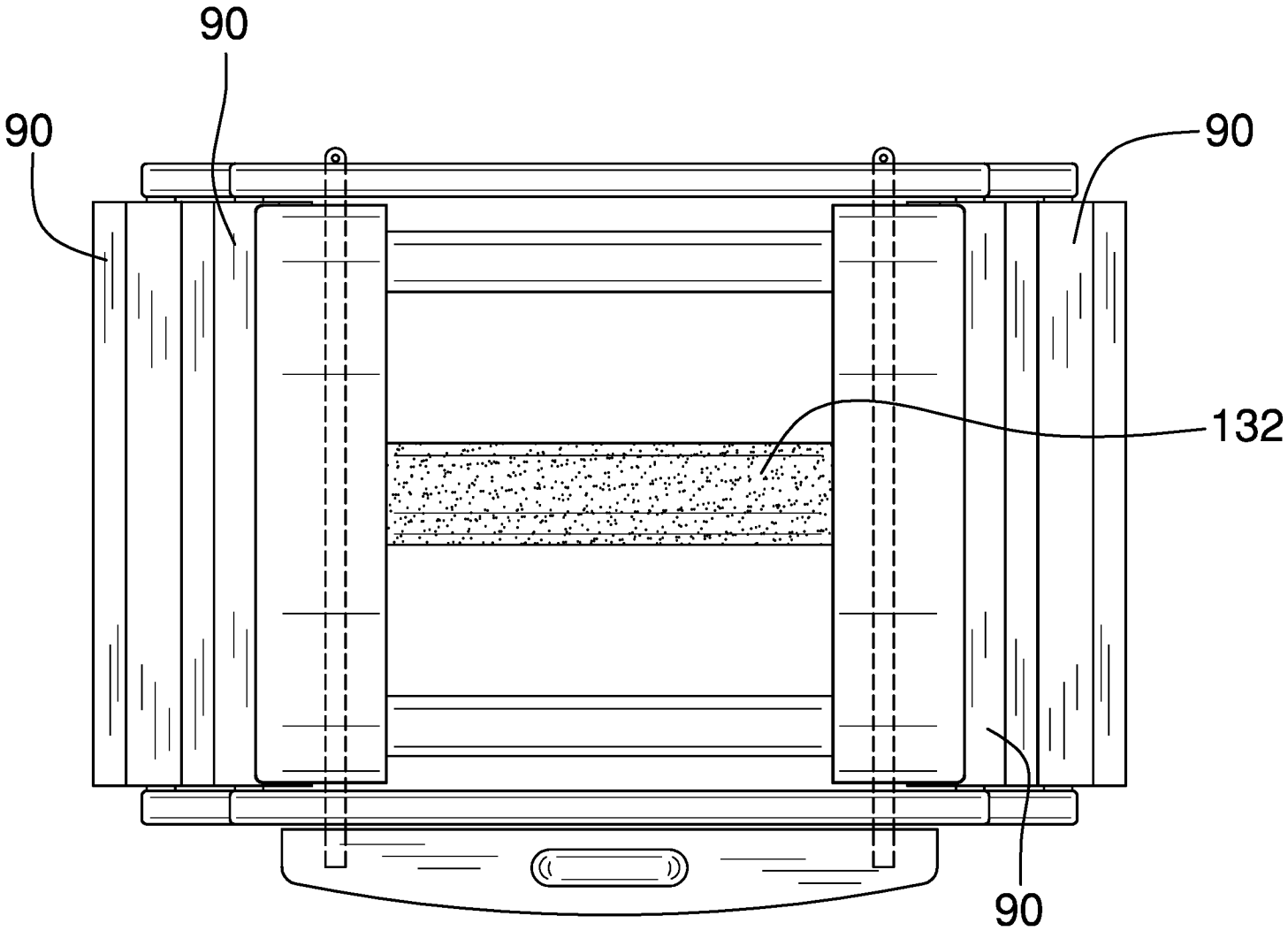
FIG. 20 is a top view of an embodiment of the disclosure as shown in FIG. 19 and further including the coupler.

In the present embodiment, it may be beneficial to alternate the distance between the first 92 and second 94 lateral edges as is shown in FIG. 19. Weights 90 having this structure will allow the weights 90 to be stacked on each other in such a manner that each weight 90 with a shorter distance sits within a portion of the receiving space of the weight 90 having a longer distance. Since the bodies 98 all have a same size and shape, these weights 90 will typically also have receiving spaces 96 that alternate in interior width. Moreover, as can be seen in FIG. 19, the ability of the weights 90 to nest within adjacent receiving spaces 96 allows the shorter ones of the weights 90 to rearwardly or forwardly abut the arms 104, 106 to further stabilize the system 10.

As with the embodiment described above, the weights 90 may each have a same mass relative to each other and be provided in conventional increments such as 2.5 lbs., 5 lbs., or 10 lbs. These increments are just an example and may be provided in alternate increments. The cumulative weight of the weights 90 may be indicated by indicia as described above and shown in FIG. 9. Also, again, the indicia, instead of displaying numbers, may comprise or also include color coding to indicate cumulative weight. The color coding may be placed on the bodies 98 or the arms 104, 106. An uppermost one of the weights 90 may include indicia that is not in a regular increment as the remaining ones of the weights 90 for reasons described above. The overall mass of each body 98 may be altered by increasing or decreasing its circumference taken perpendicular to its longitudinal axis extending through the front 100 and rear 102 sides. Typically a diameter of the bodies 90, taken perpendicular to their longitudinal axis, is between 1.0 inches and 2.0 inches, though it should be readily apparent that this diameter may be changed as needed to effect the overall mass of the weights 90. When the weights 90 are stacked as shown in FIG. 19, their total height will typically be between 5.0 inches and 14.0 inches.

A handle 116, having a generally same structure as handle 34, is removably extendable into the receiving space 96 and may include all the structural components, and variations thereof, of the handle 34 described above. Generally, the handle 116 includes a first lateral panel 118 and a second lateral panel 120 which are each vertically orientated. The first 118 and second 120 lateral panels each has an inner surface 122, an outer surface 124 and a perimeter edge 126. The perimeter edge 126 includes a front edge 128 and a rear edge 130 positioned oppositely of each other. A grip 132 is attached to and extends between the inner surfaces 122 of the first 118 and second 120 lateral panels. The grip 132 is centrally located on the first 118 and second 120 lateral panels. The perimeter edges 126 of the first 118 and second 120 lateral panels are aligned with each other.

Figure 23:
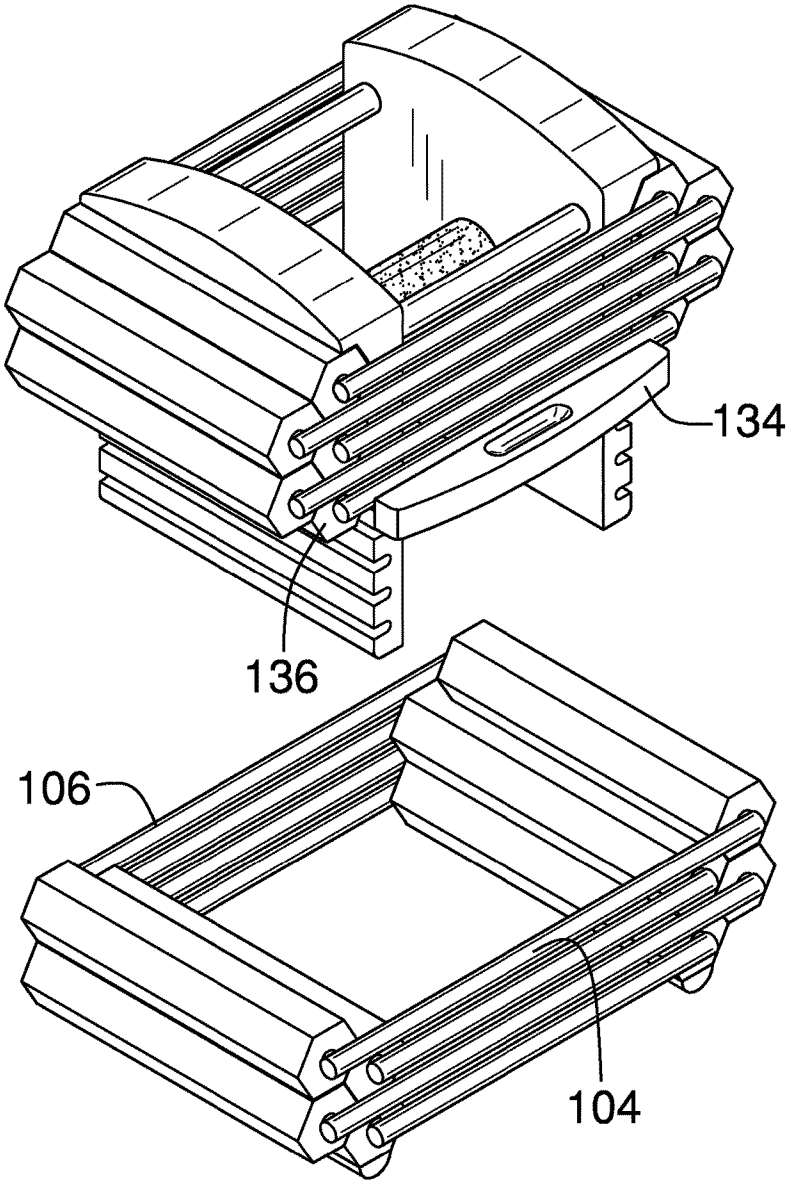
FIG. 23 is a top isometric view of an embodiment of the disclosure showing an in-use view of an alternate embodiment of the system.

As shown best in FIG. 23, a coupler 134 releasably engages a selected one of the weights 90 to the handle 116 and defines a coupled weight 136. The coupled weight 136 and each of the weights 90 positioned above the coupled weight 136 is releasably secured to the handle 116. Each of the weights 90 positioned below the coupled weight 136 are disengaged from the handle 116. The first 118 and second 120 lateral panels include a shoulder 138 to facilitate retaining the weights 90 in a static position relative to the handle 116. The shoulders 138 may include an interior surface facing and abutting an uppermost one of the weighs 90 having a shape that contours to the bodies 98 of the weights. The shoulders may extend further over the uppermost one of the weights 98 such that it is not viewable from above.

The front edges 128 each have a plurality of receivers 140 therein that are disposed in vertical alignment with each other, wherein the receivers 140 are releasably engageable with the coupler 134. As with handle 34, each of the receivers 140 in one of the front edges 128 is horizontally aligned with one of the receivers 140 in the other one of the front edges 128 to define a pair of receivers 140. Each pair of receivers 140 is aligned with one of the weights 90 and more particularly positioned under the arms 104, 106 of the aligned weight. The coupler 134 includes a pair of tines 142 attached to a handhold 144. The tines 142 are engageable with each of the front 104 and rear 106 arms of one of the weights 90 and an associated pair of the receivers 140. The handhold 144 may be retained in place with magnets, detents on the tines, tethers, mechanical fasteners such as clips, and the like.

In use, when the grip 132 is lifted, the handle 116, coupler 134, coupled weight 136 and all weights 90 there above are lifted upwardly such that the weights 90 below the coupled weight 136 are not engaged with the handle 116 and therefore left behind. The system 10 is thereafter used in a typical manner as would be standard dumbbells.

Figure 24:
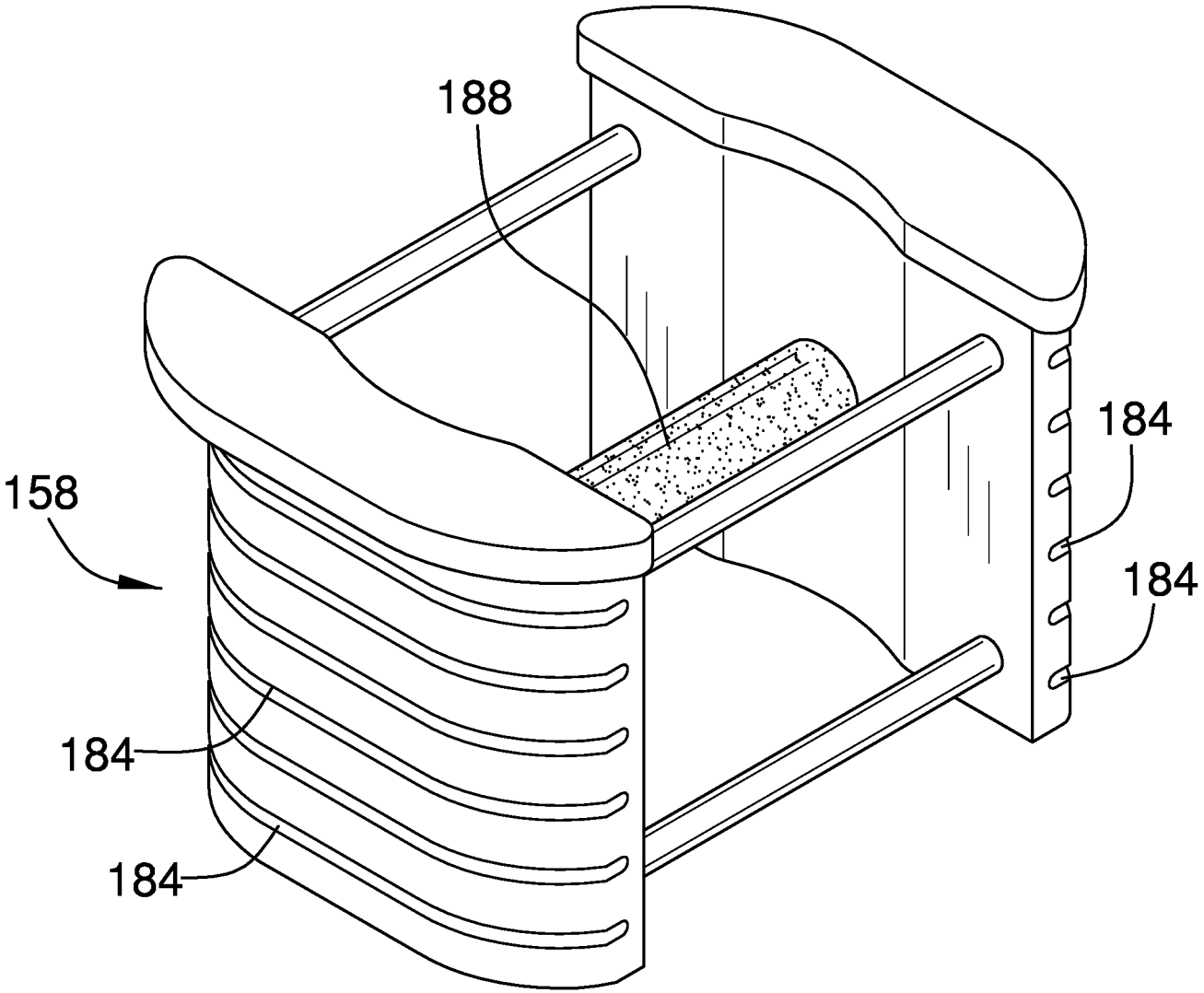
FIG. 24 is a top isometric view of an embodiment of disclosure showing a modified handle of the system.
Figure 25:
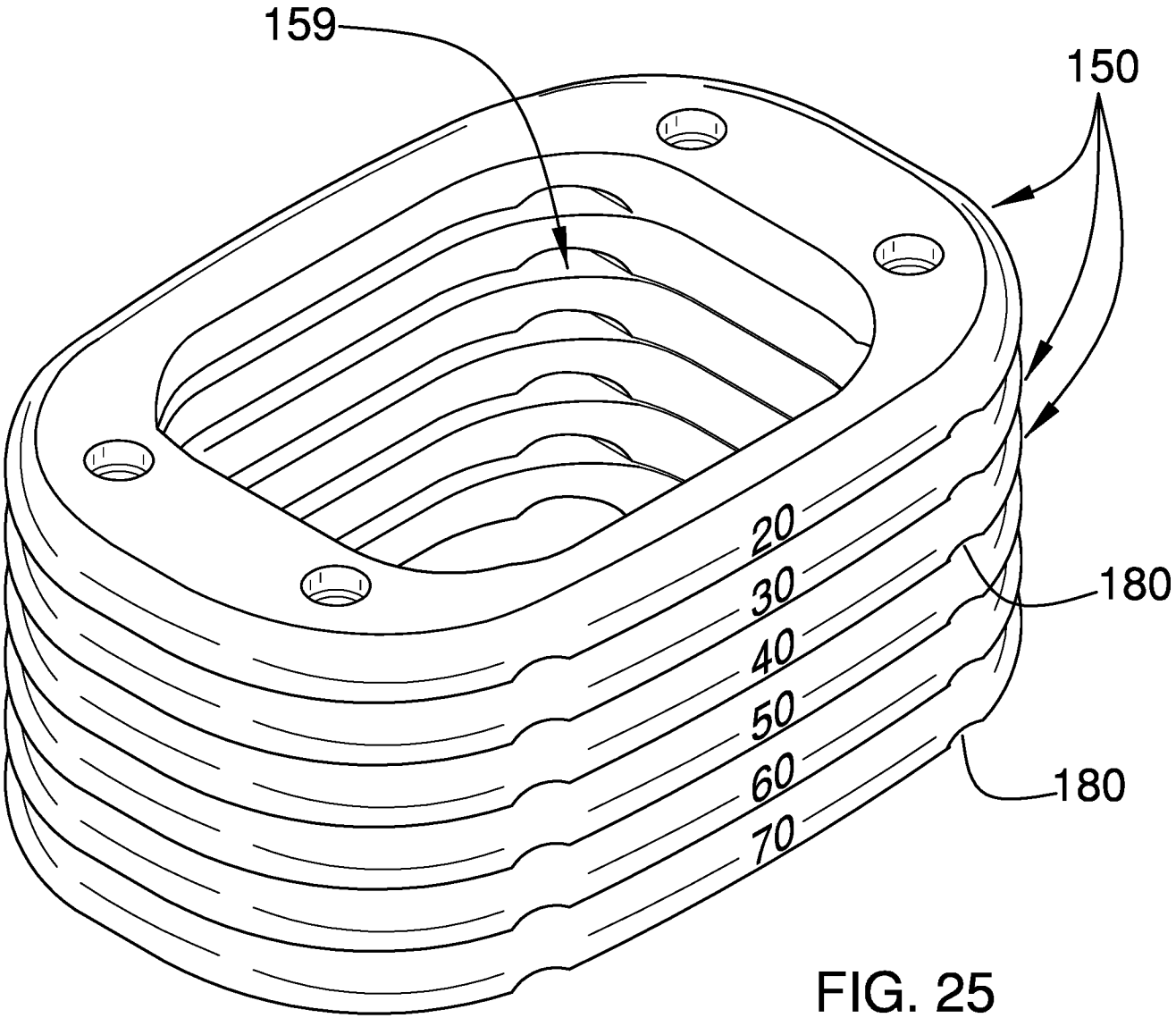
FIG. 25 is a top isometric view of a plurality of weights of an embodiment of the system.
Figure 26:
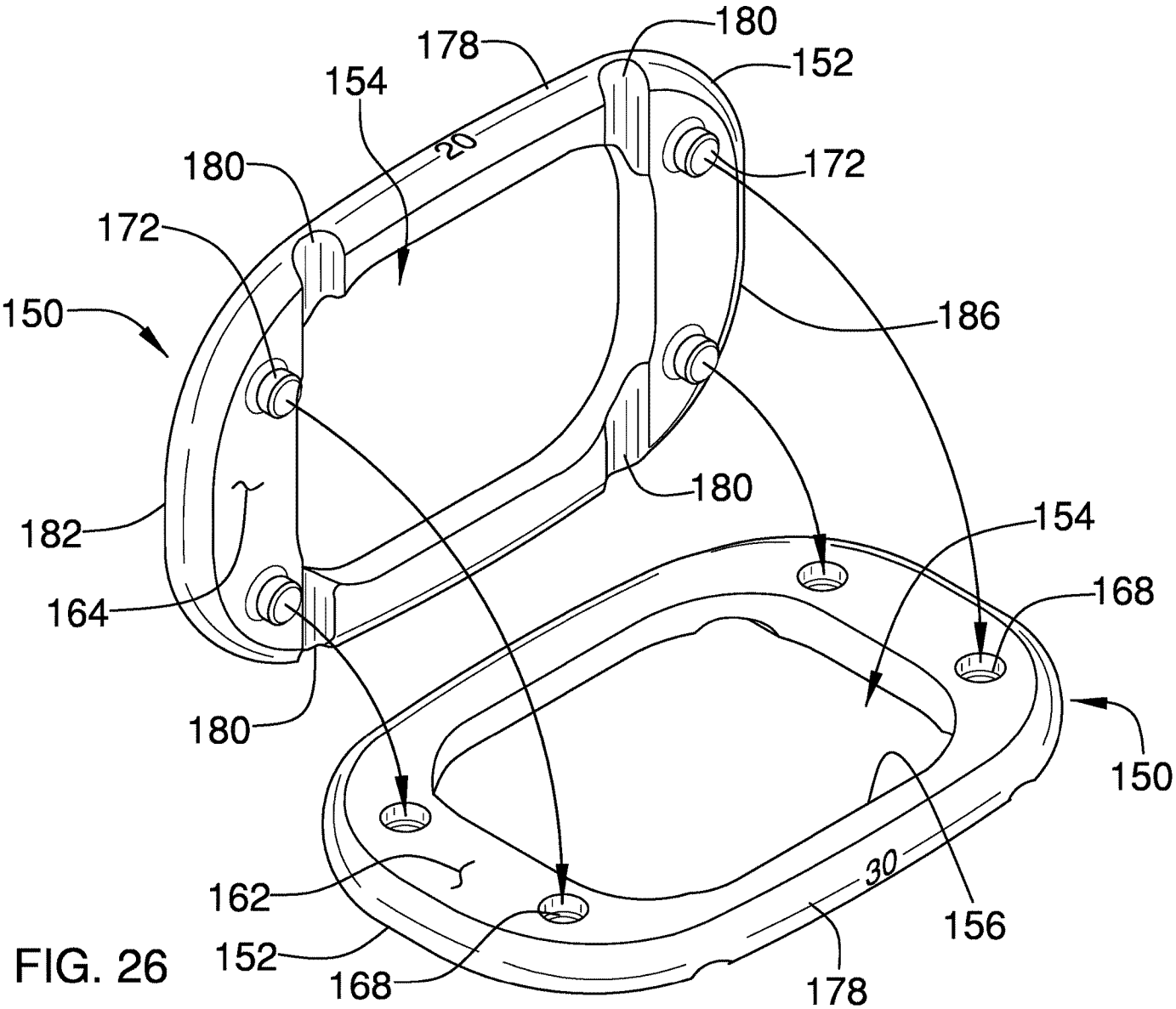
FIG. 26 is a top and bottom isometric view of a pair of weights of the embodiment of FIG. 25 of the system.
Figure 27:
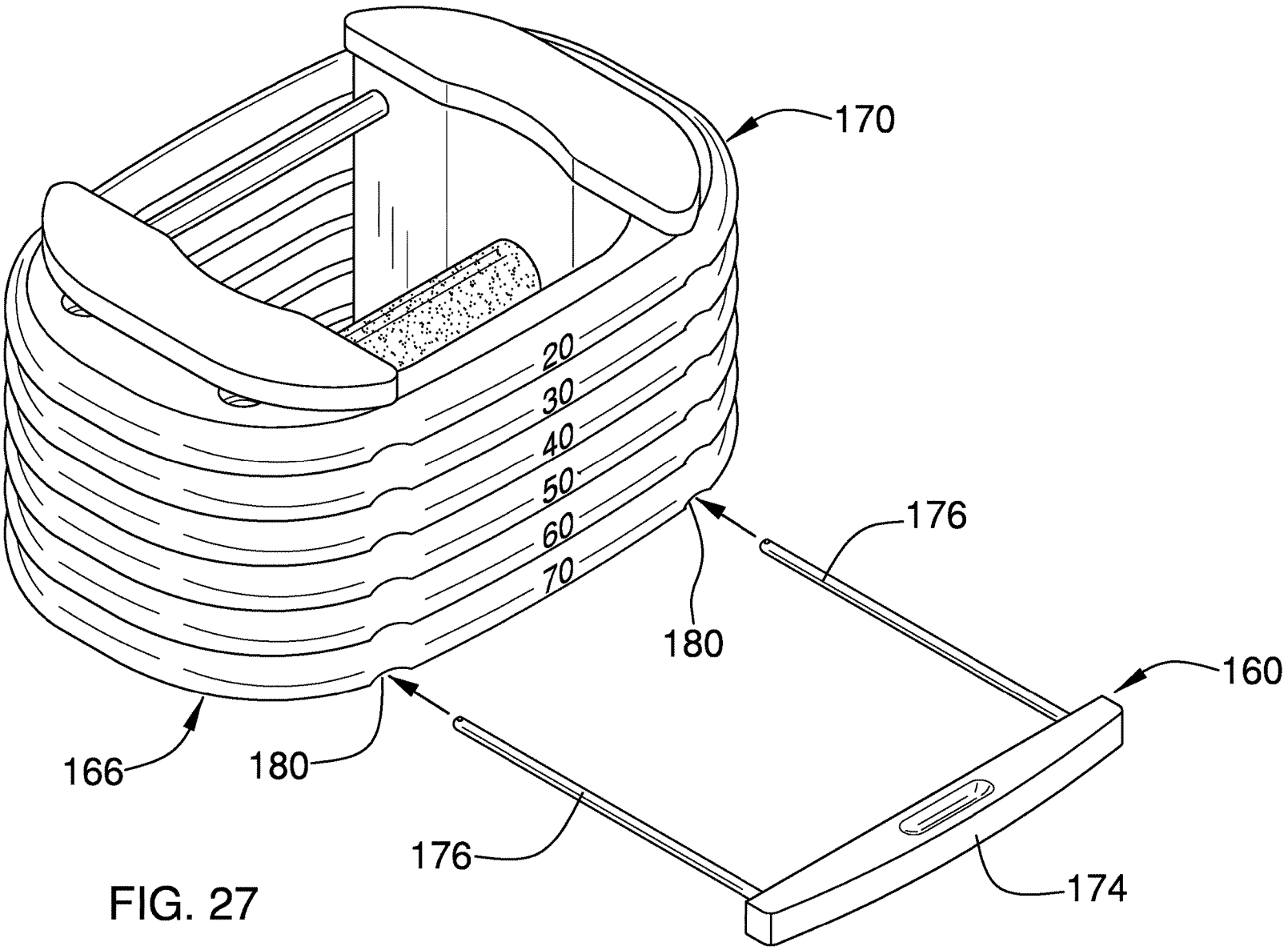
FIG. 27 is a top isometric view and embodiment the system.
Figure 28:
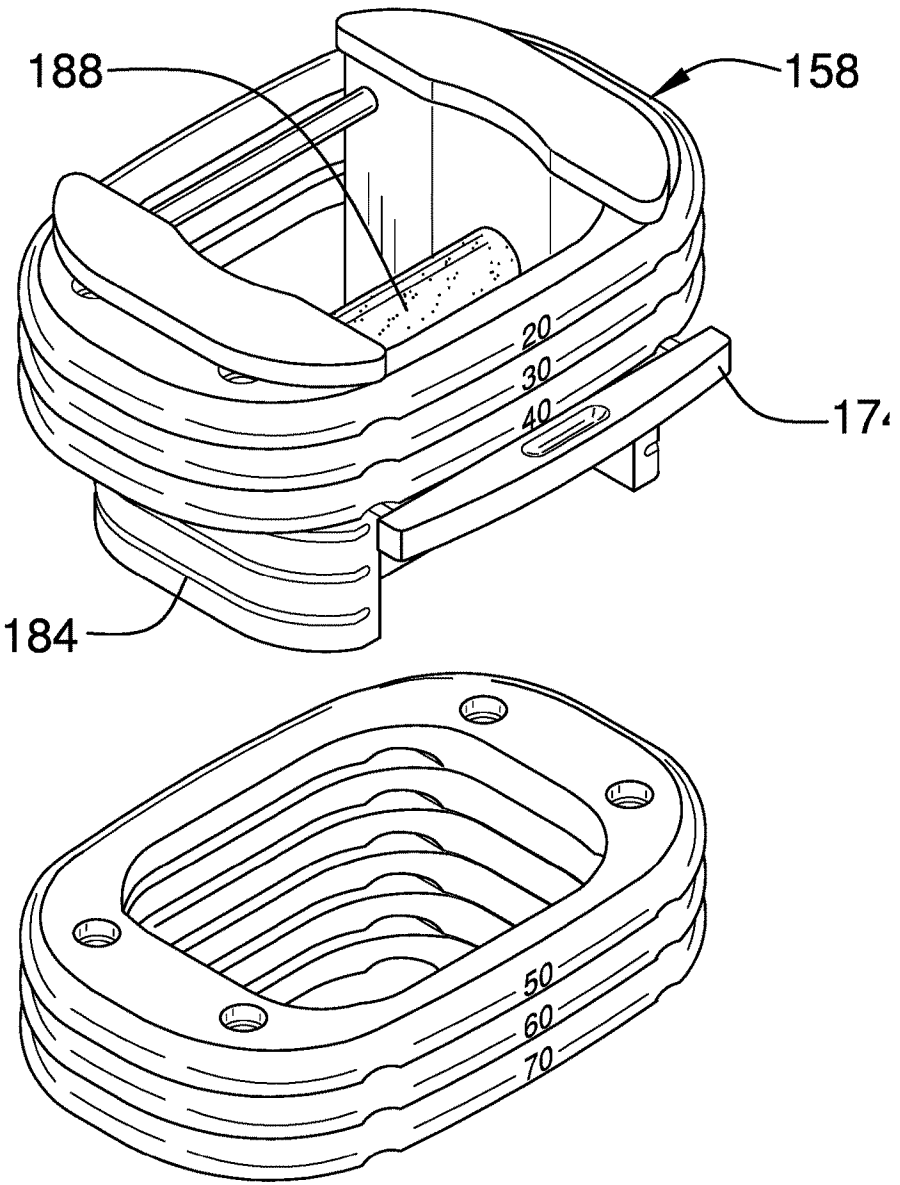
FIG. 28 is a top isometric view of an embodiment of the system depicted in FIG. 27.

FIGS. 24 through 28 show a third embodiment utilizing weights 150 having a substantially unitary structure. The term "unitary structure" herein is intended to define a weight 150 that is comprised of a single piece of material and does not include arms or rails extending between plates or bodies to form the weights. The unitary structure herein may include, for example, a cast material, such as iron or iron alloys, whereby a mold is used to form the entirety of a single plate 152. The weights 150 may likewise be stamped out of metallic material in a finished shape or begin as a single continuous, or substantially continuous, plate and thereafter having a centrally displaced opening 154 stramped or otherwise removed from a continuous plate. Thus, each single plate 152 herein comprises a unitary structure having the centrally displaced opening 154 extending therethrough. The single plate 152 of each weight 150 has an inner perimeter edge 156 defining the centrally displaced opening 154. The inner perimeter edge 156 of each weight additionally extends completely around and bounds a handle 158 when the handle 158 is in a receiving space 159 formed by the centrally displaced openings 154 of stacked ones of the weights 150. As can be seen in FIGS. 24, 27 and 28, the handle 156 and a coupler 160 are of the same general structure and function as the above embodiments shown in FIGS. 1 through 23. Thus, there handle 156 again includes a plurality receivers 184, aligned in pairs, for receiving a pair of tines 176.

The weights 150 of this embodiment may be provided as a core of cast material encapsulated in a rubber or plastic material for aesthetics and comfort. However, the weights will not include any mechanical fasteners of fastening means as the "arms" and the "plates" of this embodiment are a single, non-removable structure, most typically formed as a single piece of material. As such, the shape may be more oblong and rounded, though a general overall rectangular shape may be utilized. It should be understood, however, that the weights 150 may consist of a cast or stamped material only without any coatings or other coverings.

Each weight 150 has an upper surface 162 and a lower surface 164, wherein each weight 150 positioned above a lowermost weight 166 may have an upper surface 162 including a first mating member 168 and each weight positioned below an uppermost weight 170 has a lower surface 164 that may include a second mating member 172. The first 168 and second 172 mating members of adjacent ones of said weights 150 are releasably engageable to prevent the weights 150 from moving laterally with respect to each other. As can be seen in the Figures, in one embodiment, the first mating members 168 may comprise a well and the second mating members 172 comprising feet extendable into corresponding wells. This structure has the added benefit wherein the lowermost weight 166 may also include the second mating members 172 to lift the lowermost weight 166 off of a ground surface for easier engagement with the coupler 160. The first 168 and second 172 mating members may be cast as part of the unitary structure of the weights 150, though the first 168 and second 172 mating members are generally not considered as part of the unitary structure of the weights 150 as defined herein. As can be seen in the Figures, each weight 150 may include a plurality each of the first 168 and second 172 mating members.

As with other embodiments, the coupler 160 comprises a handhold 174 and a pair of tines 176 extending away from the handhold 174. The tines 176 are extendable between a pair of adjacent weights 150 and being engageable with the handle 158. Each weight 150 has the lower surface 164, an outer perimeter edge 178, and the inner perimeter edge 156. Each of said lower surfaces 164 has a plurality of slots 180 therein and each of the slots 180 extend through the inner 156 and outer 178 perimeter edges. The slots 180 receive the tines 176 and allow the tines 176 to extend between adjacent ones of the weights 150. The plurality of slots 180 includes a first pair of slots nearer a first lateral edge 182 and being aligned with one receiver 184 of a pair of receivers in the handle 158 and a second pair of slots 180 nearer a second lateral edge 186 and being aligned with another one of the receivers 184 of the pair of receivers. It should be understood that the slots 180 could instead be positioned on the upper surfaces 162.

As with the other embodiments, the handle 158 includes a grip 188 which is positioned between the uppermost weight 170 and the lowermost weight 166 when the handle 158 is placed in the receiving space 159. When the coupler 160 engages the handle 158 by extending the tines 176 between adjacent ones of the weights 150, or below the lowermost weight 166, all weights 150 positioned above the coupler 160 are releasably engaged to the handle 158. This allows the grip 188 to be held onto by person exercising to lift the weights 150 positioned above the coupler 160.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stacked weight system comprising:

a plurality of weights being vertically stackable on top of each other, each weight of the plurality of weights having a pair of outer edges disposed oppositely from each other and defining a first lateral edge and a second lateral edge, the plurality of weights each having a centrally displaced opening vertically extending therethrough and defining a receiving space, the receiving space of each weight of the plurality of weights being vertically aligned with the receiving space of each other weight of the plurality of weights;

a handle being removably extendable into the receiving space of each of the plurality of weights, the handle having a grip, the grip being positioned below an uppermost one of the plurality of weights and above a lowermost one of the plurality of weights when the handle is positioned in the receiving space of each of the plurality of weights;

a coupler releasably engaging a selected one of the plurality of weights to the handle and defining a coupled weight, wherein the coupled weight and each of the plurality of weights positioned above the coupled weight being releasably secured to the handle, wherein each of the plurality of weights positioned below the coupled weight are disengaged from the handle; and wherein each weight of the plurality of weights includes a unitary structure comprising a single plate having the centrally displaced opening extending therethrough, the single plate of each weight having an inner perimeter edge defining the centrally displaced opening, the inner perimeter edge of each weight bounding the handle when the handle is in the receiving space.

2. The stacked weight system according to claim 1, wherein each weight has an upper surface and a lower surface, the upper surface of each weight positioned above the lowermost weight including a first mating member comprising one of a well or a foot, the lower surface of each weight positioned below the uppermost weight including a second mating member comprising the other one of the well or the foot, wherein said first mating member and the second mating member of adjacent ones of said plurality of weights are releasably engageable to prevent the plurality of weights from moving laterally with respect to each other.

3. The stacked weight system according to claim 1, wherein the coupler comprises a handhold and a pair of tines extending away from the handhold, the pair of tines being extendable between a pair of adjacent weights of the plurality of weights and being engageable with the handle.

4. The stacked weight system according to claim 3, wherein each weight has a lower surface, an outer perimeter edge, and the inner perimeter edge, each of said lower surfaces having a plurality of slots therein, wherein each slot of the plurality of slots extends through the corresponding inner and outer perimeter edges, the plurality of slots receiving the pair of tines and allowing the pair of tines to extend between adjacent ones of the plurality of weights.

5. The stacked weight system according to claim 1, wherein each weight comprises a cast material, said cast material comprising iron or an iron alloy.

6. The stacked weight system according to claim 1, wherein each weight of the plurality of weights has a center of mass, and wherein the centers of masses of each weight of the plurality of weights are vertically aligned with each other.

7. The stacked weight system according to claim 1, wherein a distance between the first lateral edge and the second lateral edge of the uppermost one of the plurality of weights is equal to or greater than a distance between the first lateral edge and the second lateral edge of each other weight of the plurality of weights.

8. The stacked weight system according to claim 1, wherein a distance between the first lateral edge and the second lateral edge of the uppermost one of the plurality of weights is equal to or greater than a distance between the first lateral edge and the second lateral edge of at least two of the other weights of the plurality of weights.

9. The stacked weight system according to claim 1, wherein a distance between the first lateral edge and the second lateral edge of the uppermost one of the plurality of weights is equal to or less than a distance between the first lateral edge and the second lateral edge of at least two other weights of the plurality of weights.

10. The stacked weight system according to claim 1, wherein the first lateral edges of the plurality of weights are aligned with each other and the second lateral edges of the plurality of weights are aligned with each other such that the first lateral edges of the plurality of weights are aligned with a first vertical plane and the second lateral edges of the plurality of weights are aligned with a second vertical plane.

11. The stacked weight system according to claim 1, wherein the handle includes:

a first lateral panel and a second lateral panel, each of the first lateral panel and the second lateral panel being vertically orientated, each of the first lateral panel and the second lateral panel having an inner surface, an outer surface and a perimeter edge, wherein the perimeter edges of the first lateral panel and the second lateral panel include a front edge and a rear edge positioned oppositely of each other; and the grip being attached to and extending between the inner surfaces of the first lateral panel and the second lateral panel, the grip being centrally located on the first lateral panel and the second lateral panel, the perimeter edges of the first lateral panel and the second lateral panel being aligned with each other.

12. The stacked weight system according to claim 11, wherein the front edges of the first lateral panel and the second lateral panel each have a plurality of receivers therein disposed in vertical alignment with each other and releasably engageable with the coupler.

13. The stacked weight system according to claim 12, wherein:

each of the plurality of receivers in one of the front edges of the first lateral panel or the second lateral panel being horizontally aligned with one of the receivers in the other one of the front edges to define a pair of receivers, each of the pair of receivers being aligned with one of the plurality of weights;

the coupler comprising a handhold and a pair of tines extending away from the handhold, the pair of tines being extendable between a pair of adjacent weights and being engageable with the handle, each of said pair of tines being extendable into one of the pairs of the receivers; and each weight of the plurality of weights having a lower surface, an outer perimeter edge, and the inner perimeter edge, each of said lower surfaces having a plurality of slots therein, wherein each of the plurality of slots extends through the inner perimeter edge and the outer perimeter edge, the plurality of slots receiving the pair of tines and allowing the pair of tines to extend between adjacent ones of the plurality of weights, the plurality of slots including a first pair of slots being aligned with one of the receivers of the pair of receivers and a second pair of slots being aligned with another one of the receivers of the pair of receivers.

14. The stacked weight system according to claim 1, wherein each of the single plates is elongated along a line extending through the corresponding first and second lateral edges.

* * * * *